US006518007B1

(12) United States Patent
Reed et al.

(10) Patent No.: US 6,518,007 B1
(45) Date of Patent: Feb. 11, 2003

(54) SILVER HALIDE ELEMENTS CONTAINING SOLUBILIZED ANTIFOGGANTS AND LOW FOGGING TABULAR SILVER HALIDE GRAINS

(75) Inventors: Kenneth J. Reed, Rochester, NY (US); George J. Burgmaier, Pittsford, NY (US); John E. Keevert, Rochester, NY (US); Roger L. Klaus, Victor, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/014,704

(22) Filed: Dec. 11, 2001

(51) Int. Cl.[7] ..... G03C 1/34; G03C 1/04; G03C 1/035; G03C 7/392

(52) U.S. Cl. ..... 430/545; 430/551; 430/567; 430/569; 430/607; 430/610; 430/617; 430/639

(58) Field of Search ..... 430/607, 610, 430/611, 617, 551, 545, 567, 569, 639

(56) References Cited

U.S. PATENT DOCUMENTS

| | | | | | |
|---|---|---|---|---|---|
| 3,874,946 | A | * | 4/1975 | Costa et al. | 430/617 |
| 3,946,007 | A | | 3/1976 | Goralski et al. | |
| 5,958,688 | A | * | 9/1999 | Matsumoto et al. | 430/611 |
| 6,074,813 | A | * | 6/2000 | Asanuma et al. | 430/607 |
| 6,350,569 | B1 | * | 2/2002 | Watanabe et al. | 430/611 |

OTHER PUBLICATIONS

Hans Pritzkow et al, Darstellung perhalogenierter Mesylsulfene, $X_3C–SO_2–C(X)=SO_2$, und ihre Stabilisierung durch Chinuchlidin, Feb. 1990, pp. 1187–1192.

Bruce B. Jarvis et al, J. Org. Chem., vol. 40, No. 25, 1975, pp. 3778–3780.

Dieter Scholz, Neue Synthesemethoden, 10, Liebigs Ann. Chem., 1984, pp. 264–272.

Udo Rheude et al, "Uber Reaktionen halogenierter Methansulfonylchloride mit Trimethylamin und ein inverses Sulfen–Amin–Addukt", Chem. Ber. 118, 1985, pp. 2208–2219.

George J. Burgmaier et al U.S. application Ser. No. 10/014961 "Photothermographic Materials Containing Solubilized Antifoggants" (Docket 81832/JLT).

Roger L. Klaus et al U.S. application Ser. No. 10/014990 "Silver Halide Photographic Materials Containing Solubilized Antifoggants" (Docket 82700/SMR).

George J. Burgmaier et al U.S. application Ser. No. 10/14223 "Water Soluble Halogen Containing Compounds" (Docket 83636/SMR).

* cited by examiner

*Primary Examiner*—Richard L. Schilling
(74) *Attorney, Agent, or Firm*—Sarah Meeks Roberts

(57) ABSTRACT

This invention relates to a multicolor silver halide photographic element comprising a support and at least one high bromide silver halide emulsion layer comprising low fogging tabular silver halide grains, said element further comprising an antifoggant represented by the following Structure I:

$$R_1—SO_2—C(R_2)R_3—(CO)_m—(L)_n—SG \qquad \text{I}$$

wherein $R_1$ is an aliphatic or cyclic group, $R_2$ and $R_3$ are independently hydrogen or bromine as long as at least one of them is bromine, L is a divalent linking group, m and n are independently 0 or 1, and SG is a solubilizing group that has a pKa of 8 or less.

21 Claims, No Drawings

SILVER HALIDE ELEMENTS CONTAINING SOLUBILIZED ANTIFOGGANTS AND LOW FOGGING TABULAR SILVER HALIDE GRAINS

FIELD OF THE INVENTION

This invention relates to silver halide elements containing solubilized antifoggants. More specifically it relates to silver halide elements containing solubilized antifoggants and a high bromide emulsion containing low fogging tabular silver halide grains. In one embodiment the silver halide grains are precipitated in a low pH environment.

BACKGROUND OF THE INVENTION

Problems with fogging have plagued the photographic industry from its inception. Fog is a deposit of silver or dye that is not directly related to the image-forming exposure, i.e., when a developer acts upon an emulsion layer, some reduced silver is formed in areas that have not been exposed to light. Fog can be defined as a developed density that is not associated with the action of the image-forming exposure, and is usually expressed as "D-min", the density obtained in the unexposed portions of the emulsion. Density, as normally measured, includes both that produced by fog and that produced as a function of exposure to light. It is known in the art that the appearance of photographic fog related to intentional or unintentional reduction of silver ion (reduction sensitization) can occur during many stages of preparation of the photographic element including silver halide emulsion preparation, spectral/chemical sensitization of the silver halide emulsion, melting and holding of the liquid silver halide emulsion melts, subsequent coating of silver halide emulsions, and prolonged natural and artificial aging of coated silver halide emulsions. The chemicals used for preventing fog growth as a result of aging or storage are generally known as emulsion stabilizers.

The control of fog, whether occurring during the formation of the light-sensitive silver halide emulsion, during the spectral/chemical sensitization of those emulsions, during the preparation of silver halide compositions prior to coating on an appropriate support, or during the aging of such coated silver halide compositions, has been attempted by a variety of means. Mercury-containing compounds such as those described in U.S. Pat. Nos. 2,728,663; 2,728,664; and 2,728,665 have been used as additives to control fog. Thiosulfonates and thiosulfonate esters such as those described in U.S. Pat. Nos. 2,440,206; 2,934,198, 3,047,393, and 4,960,689 have also been employed. Organic dichalcogenides, for example, the disulfide compounds described in U.S. Pat. Nos. 1,962,133; 2,465,149; 2,756,145, 2,935,404; 3,184,313; 3,318,701; 3,409,437; 3,447,925; 4,243,748; 4,463,082, and 4,788,132 have been used not only to prevent formation of fog, but also as desensitizers and as agents in processing baths and as additives in diffusion transfer systems Recently there has appeared in the patent literature art that describes the precipitation of silver halide photographic emulsions in a peptizer, cationic waxy starch , which departs substantially from the traditionally used medium, gelatin. These starch precipitated emulsions may be unique in their ability to tolerate the use of powerful oxidants such as elemental bromine or else very low pH used during the precipitation (U.S. application Ser. No. 09/731,454 "PREPARATION OF HIGH CHLORIDE PHOTOGRAPHIC EMULSIONS WITH STARCH PEPTIZER", Ser. No. 09/731,454 "PREPARATION OF HIGH BROMIDE PHOTOGRAPHIC EMULSIONS WITH STARCH PEPTIZER AND OXIDIZING AGENT", and Ser. No. 09/731,446 "PREPARATION OF HIGH BROMIDE PHOTOGRAPHIC EMULSIONS WITH STARCH PEPTIZER" of Maskasky, all filed Dec. 7, 2000). Oxidized cationic starches are advantageous in exhibiting lower levels of viscosity than gelatino-peptizers. This facilitates mixing. Under comparable levels of chemical sensitization higher photographic speeds can be realized using cationic starch peptizers. Alternatively, speeds equal to those obtained using gelatino-peptizers can be achieved at lower precipitation and/or sensitization temperatures, thereby avoiding unwanted grain ripening. The starch peptized emulsions, when precipitated under certain conditions, also exhibit low Dmins, presumably as a consequence of either the removal of or the prevention of metallic silver center formation which gives rise to primitive emulsion fog. The use of cationic starch as a peptizer for the precipitation of high bromide {111} tabular grain emulsions is taught by Maskasky in U.S. Pat. Nos. 5,604,085; 5,620,840; 5,667,955, 5,691,131; and 5,733,718.

Starch peptized emulsions precipitated either at low pH or else in the presence of bromine or a bromine precursor appear particularly well suited for use with very active chemistries such as fragmental electron donors, FEDs (J. E. Maskasky et. al U.S. Pat. No. 6,090,536), one equivalent yellow couplers (J. E. Maskasky et. al U.S. Pat. No. 6,225,036), light scattering particles (J. E. Maskasky et. al U.S. Pat. No. 6,027,869), and combinations of these chemistries. These active chemistries, however, tend to amplify image and fog. While the use of the starch peptized emulsions may provide a good initial Dmin position, further fog reduction is necessary to in order to obtain the maximum imaging performance.

SUMMARY OF THE INVENTION

This invention provides a multicolor silver halide photographic element comprising a support and at least one high bromide silver halide emulsion layer comprising low fogging tabular silver halide grains, said element further comprising an antifoggant represented by the following Structure I:

$$R_1—SO_2—C(R_2)R_3—(CO)_m—(L)_n—SG \qquad \text{I}$$

wherein $R_1$ is an aliphatic or cyclic group, $R_2$ and $R_3$ are independently hydrogen or bromine as long as at least one of them is bromine, L is a divalent linking group, m and n are independently 0 or 1 and SG is a solubilizing group that has a pKa of 8 or less.

This invention further provides silver halide elements with an unexpected improvement in the fog position of already quite clean or low fog emulsions, particularly starch precipitated emulsions. These improvements translate to substantial imaging advances as measured by speed and image structure (granularity) metrics.

DETAILED DESCRIPTION OF THE INVENTION

The silver halide photographic elements of this invention include one or more water-soluble or water-dispersible antifoggants containing a solubilizing group with a pKa of 8 or less. These compounds are represented by the following Structure I.

$$R_1—SO_2—C(R_2)R_3—(CO)_m—(L)_n—SG \qquad \text{I}$$

wherein $R_1$ is a substituted or unsubstituted aliphatic or cyclic group of any size as long as the antifoggant remains soluble or readily dispersible in water. Substituted or unsubstituted aliphatic groups for $R_1$ include monovalent groups having 1 to 20 carbon, nitrogen, sulfur, and oxygen atoms in the chain including, but not limited to, chains that include one or more substituted or unsubstituted alkyl groups having 1 to 10 carbon atoms, substituted or unsubstituted alkenylene groups having 2 to 20 carbon atoms, substituted or unsubstituted alkylenearylene groups having 7 to 20 carbon atoms in the chain, and combinations of any of these groups, as well as combinations of these groups that are connected with one or more amino, amido, carbonyl, sulfonyl, carbonamido, sulfonamido, thio, oxy, oxycarbonyl, oxysulfonyl, and other connecting groups that would be readily apparent to one skilled in the art. The various types of useful aliphatic groups would be readily apparent to one skilled in the art. Preferred aliphatic groups for $R_1$ include substituted or unsubstituted t-butyl groups and trifluoromethyl groups.

$R_1$ can also be substituted or unsubstituted cyclic groups including substituted or unsubstituted carbocyclic aryl groups having 6 to 14 carbon atoms to form the cyclic ring, substituted or unsubstituted cycloalkylene groups (having 5 to 10 carbon atoms to form the cyclic ring), and heterocyclic groups (having 5 to 10 carbon, nitrogen, sulfur, or oxygen atoms to form the cyclic ring), both aromatic and non-aromatic. The various types of cyclic groups would be readily apparent to one skilled in the art.

Preferred cyclic groups for $R_1$ include substituted or unsubstituted aryl groups having 6 to 10 carbon atoms to form the cyclic ring. Substituted or unsubstituted phenyl groups are most preferred. Methyl groups are preferred substituents on the phenyl group.

In Structure I, $R_2$ and $R_3$ are independently hydrogen or bromine as long as one of them is bromine. Preferably, both $R_2$ and $R_3$ are bromine.

In addition, L is a substituted or unsubstituted divalent linking group, and more preferably an aliphatic linking group that can have the same definition as $R_1$ except that L is divalent. Thus, one skilled in the art would be able to determine suitable L groups that would serve the desired purpose while maintaining compound water solubility or dispersibility. Preferably, L is —NH-alkylene wherein "alkylene" is substituted or unsubstituted and has 1 to 10 carbon atoms (more preferably 1 to 3 carbon atoms).

Substituents on $R_1$ and L can be any chemical moiety that would not adversely affect the desired function of the antifoggant and can include, but are not limited to, alkyl, aryl, heterocyclic, cycloalkyl, amino, carboxy, hydroxy, phospho, sulfonamido, sulfo, halo, and other groups that would be readily apparent to one skilled in the art. The number of substituents is limited only by the number of available valences (available hydrogen atoms). Alkyl groups are preferred substituents for cyclic $R_1$ groups. However, as would be apparent, the antifoggants can have multiple sulfo, carboxy, phospho, and sulfonamido groups that impart water solubility to the molecule. Further, in Structure I, m and n are independently 0 or 1, and preferably, both are 1.

SG can be any suitable solubilizing group which has a pKa of 8 or less and which does not interfere with the antifogging activity of the compound. SG may be in the free acid form or it may be a salt, particularly a suitable metal (for example, alkali metal salt) or ammonium ion salt. Preferably, SG is a salt. When SG is in its free acid form, the salt can be generated in situ by neutralization with any basic material commonly used by one skilled in the art. Preferably SG is a carboxy, phospho, sulfo, or sulfonamido group. When SG is a sulfonamido group, it may be $—SO_2N^-COR_4M^+$, or $—NSO_2R_4M^+$ with $R_4$ being a substituted or unsubstituted aliphatic or cyclic group that is defined the same as for $R_1$, although $R_1$ and $R_4$ can be the same or different in a particular compound. Preferably, SG is a carboxy or sulfo group (or salts thereof), particularly when both m and n are 1.

$M^+$ is a suitable cation such as a metal cation (preferably alkali metal ion) or an ammonium ion. When $M^+$ is a hydrogen atom, the resulting free acid can be easily solubilized by neutralization with any convenient base, such as, for example, potassium hydroxide or sodium bicarbonate.

Representative antifoggants useful within the practice of this invention include the following compounds:

A-1

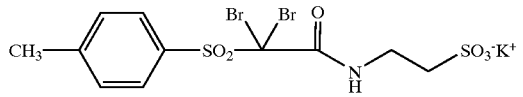

A-2

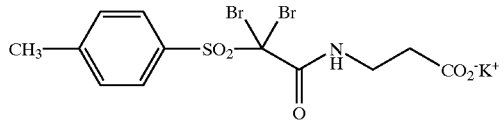

A-3

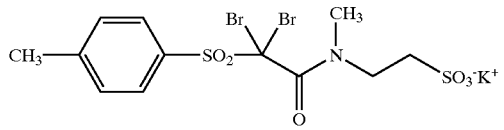

A-4

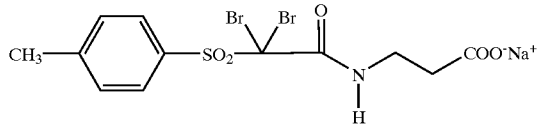

A-5

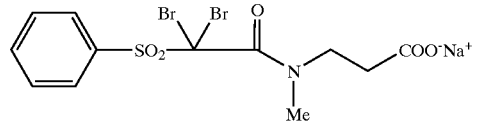

A-6

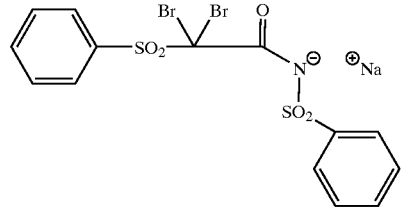

A-7

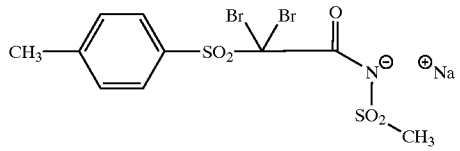

-continued
A-8
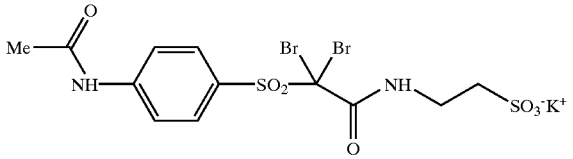
A-9
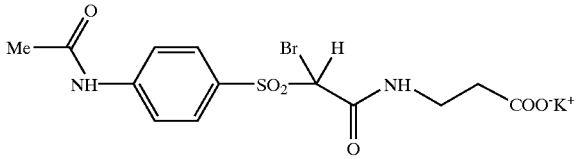
A-10
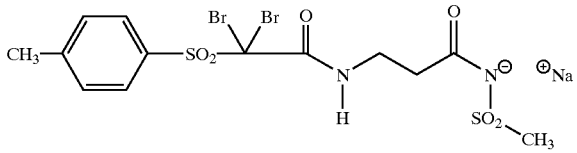
A-11
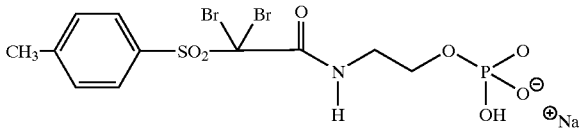
A-12
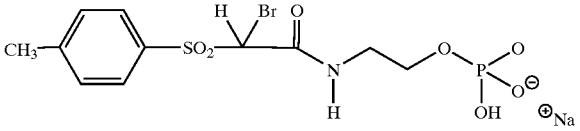
A-13
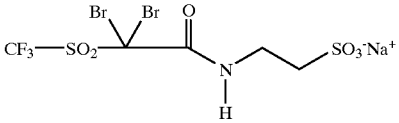
A-14
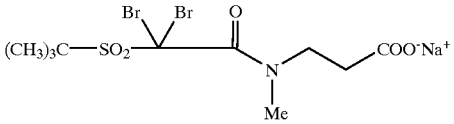
A-15
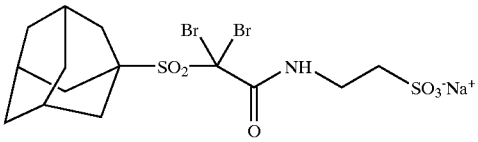
A-16
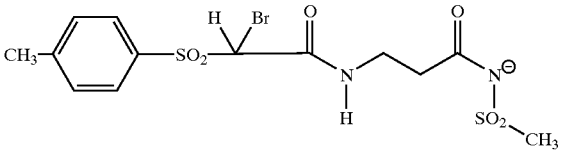
A-17
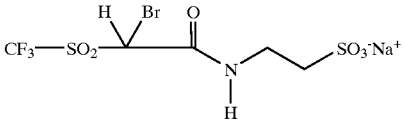
-continued
A-18
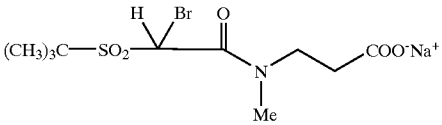
A-19
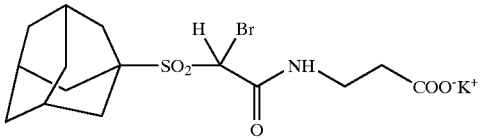
A-20
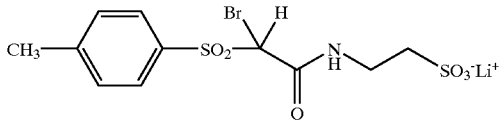
A-21
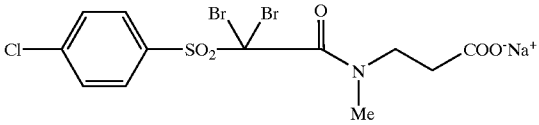
A-22
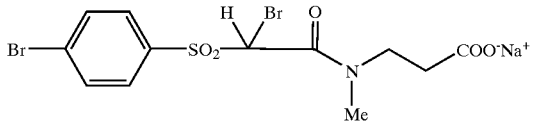
A-23
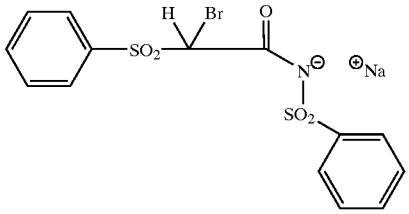
A-24
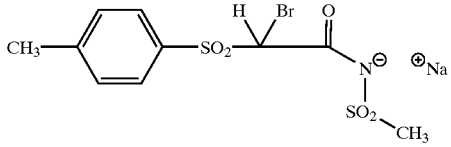
A-25
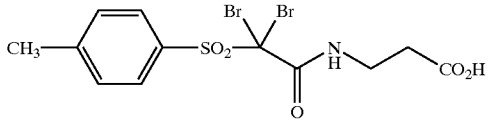
A-26
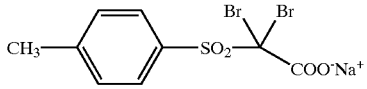
A-27
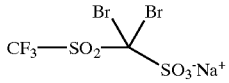

-continued

A-28

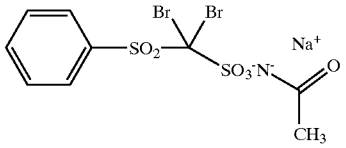

A-29

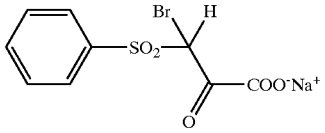

A-30

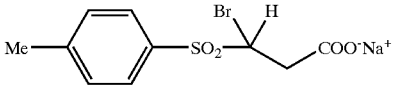

A-31

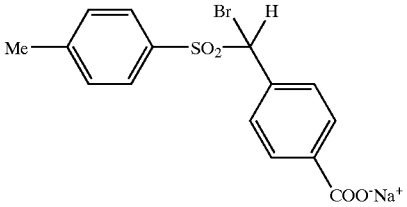

The compounds represented by Structure I can be prepared using starting materials and procedures that would be readily apparent to one skilled in the art. For example, compounds wherein m is 1 (and n is 0 or 1) can be prepared by reacting a salt of a sulfinic acid (such as p-toluenesulfinic acid, sodium salt) with a 2-bromomethylcarbonyl derivative, followed by bromination of the resulting sulfone using molecular bromine or another suitable brominating agent.

Instead of using the salt of a sulfinic acid, an aromatic or aliphatic thiol can be condensed with the 2-bromomethylcarbonyl derivative followed by oxidation of the thioether to a sulfone and then subsequent bromination.

Some 2-bromomethylcarbonyl derivatives can be prepared by reacting bromoacetylbromide with amines such as taurine, as described in U.S. Pat. No. 5,091,298 (Parton et al), with glycine, as described in the Journal of the Korean Society of Textile Engineers and Chemists, p 13, December 1981 (Hwang et al), or with methanesulfonamide, as described in U.S. Pat. No. 5,620,989 (Harrison et al).

Monobromination can be achieved by using only one equivalent of a source of bromine, using a less active brominating agent, or by adjusting reaction conditions as one skilled in the art would readily understand.

By "water-soluble" or "water-dispersible" in defining the antifoggants is meant that the compounds are readily dissolved or dispersed in water. Therefore, their use in silver halide emulsions and photographic elements alleviates the need for volatile organic solvents and circumvents the disadvantages of using solid particle dispersions. In order to be "water-soluble" or "water-dispersible", it should be possible to add between 0.1 g and 500 g of the antifoggant to 1000 mL of water. Optimally, it should be possible to add between 50 g and 200 g of the antifoggant to 1000 mL of water. The antifoggants can be used individually or in combination in the elements of this invention. Generally, they are present in an amount of at least 0.0001 mol/mol of total silver. Preferably, they are present in an amount of from about 0.001 to about 0.1 mol/mol of total silver.

The antifoggant compounds may be added to any layer where they are in reactive association with the silver halide. By "in reactive association with" it is meant that the compounds must be contained in the silver halide emulsion layer or in a layer whereby they can react or interact with, or come in contact with, the silver halide emulsion. Preferably, the antifoggants are included in the one or more emulsion layers, but during manufacture, they can also be incorporated into interlayers, underlayers, and protective topcoat layers on the frontside of the support. If they are placed in a non-emulsion layer, they tend to migrate into the emulsion layer(s) where they become effective in reducing $D_{min}$. The antifoggant compounds may be added to the photographic emulsion using any technique suitable for this purpose.

The photographic emulsions use in this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The antifoggants may be added to the silver halide emulsion at any time during the preparation of the emulsion i.e. during precipitation, during or before chemical sensitization or during final melting and co-mixing of the emulsions and additives for coating. More preferably these compounds are added after precipitation and washing and most preferably during or directly after chemical sensitization of the final melt.

The antifoggants may be utilized in addition to any conventional emulsion stabilizer or antifoggant as commonly practiced in the art. Combinations of the antifoggants of the invention may also be utilized.

The photographic element of this invention comprises tabular grain silver halide emulsions. Tabular grains are those with two parallel major faces each clearly larger than any remaining grain face. Tabular grain emulsions are those in which the tabular grain population accounts for at least 50 percent, preferably >70 percent and optimally >90 percent of the total emulsion projected area. The tabular grain population can account for substantially all (>97 percent) of the total emulsion projected area. The tabular grain emulsions can be high aspect ratio tabular grains, i.e., ECD/t>8, where ECD is the diameter of a circle having an area equal to the projected grain area and t is tabular grain thickness; intermediate aspect ratio tabular grain emulsions—i.e., ECD/t=5 to <,=8; or low aspect ratio tabular grain emulsions—i.e., ECD/t=2 to <5. The emulsions typically exhibit high tabularity (T), where T (i.e., ECD/$t^2$)>25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m. The tabular grains preferably have an average equivalent circular diameter of at least 1 $\mu$m, more preferably at least 2 $\mu$m and most preferably at least 3 $\mu$m. The high bromide {111} tabular grain emulsions can exhibit mean grain ECD's of any conventional value, ranging up to 10 $\mu$m, which is generally accepted as the maximum mean grain size compatible with photographic utility. In practice, the tabular grain emulsions of the invention typically exhibit a mean ECD in the range of from about 0.2 to 7.0 $\mu$m. Tabular grain thicknesses typically range from about 0.03 $\mu$m to 0.3 $\mu$m. For blue recording somewhat thicker grains, up to about 0.5 $\mu$m, can be employed. For minus blue (red and/or green) recording, thin (<0.2 $\mu$m) tabular grains are preferred.

Tabular grains formed of silver halide(s) that form a face centered cubic (rock salt type) crystal lattice structure can have either {100} or {111} major faces. A summary of tabular grain emulsions is contained in Research Disclosure, Item 38957, published by Kenneth Mason Publications, Ltd., Dudley Annex, 12a North Street, Emsworth, Hampshire PO 10 7DQ, ENGLAND, I. Emulsion grains and their preparation, B. Grain morphology, particularly subparagraphs (1) and (3). In a particularly preferred embodiment, the invention utilizes high bromide {111 } tabular grain emulsions, wherein a water dispersible cationic starch is present during the precipitation (during nucleation and grain growth or during grain growth) of high bromide {111} tabular grains. High bromide {111} tabular grain emulsions are those in which greater than 50 percent of total grain projected area is accounted for by tabular grains having {111} major faces and containing greater than 50 mole percent bromide, based on silver.

The high bromide emulsions utilized in the invention contain "low fogging" tabular silver halide grains. One definition of a "low fogging" emulsion is a fully surface spectrochemically sensitized emulsion with a low 'intrinsic fog level', defined as the fraction (Dmin-base density) divided by its net maximum density (Dmax-base density). Base density is determined by subjecting samples to a fixing step before the normal color development process. Maximum density is achieved when samples are given sufficient exposure above Dmin such that 0.6 log E less exposure produces less than 6% density reduction. This is measured in a format that is coupler rich, meaning it contains greater than or sufficient coupler on a molar basis that can fully react with the amount of silver halide moles coated per unit area. To demonstrate 'normal fog' vs. 'low fogging' emulsions, an emulsion containing layer may comprise 40 mg Ag/$ft^2$, 400 mg gelatin/$ft^2$, suitable surfactants, and 2 g tetraazaindene/mole of Ag, as well as a color forming coupler. As an example of a yellow record coupler, 120 mg YRC-1/$ft^2$ may be used in the emulsion layer. For a magenta record demonstration, 193 mg MRC-1/$ft^2$ may be used. For a cyan record example, 56 mg CRC-1/$ft^2$ may be used. A nominal gel overcoat is typically used, for example, a 250 mg/$ft^2$ gelatin overcoat hardened at 1.8% wt/wt hardener to total gelatin in the coating. A nominal time of development of 3' 15" in C-41 KODAK Color Negative Developer is used. A fully spectrochemically sensitized emulsion in this definition refers to one or more spectral sensitizing dyes being present that impart either cyan, magenta, or yellow spectral sensitization. Furthermore, the emulsion has been optimally chemically sensitized with a sulfiding agent such as sodium thiosulfate, a gold sensitizing agent such as potassium tetrachloroaurate, a reduction sensitizing agent such as stannous chloride or thiourea dioxide- or any two- or three-way combination of these three classes of chemical sensitizers.

It is known that the different couplers used in the different color records have influence on the extent of development of given silver halide emulsion experiences, such that different 'intrinsic fog levels' are defined for the different color records. For the blue sensitive or yellow record, an 'intrinsic fog level' fraction of 0.037 or less distinguishes 'low fogging' emulsions. For the green sensitive record, an 'intrinsic fog level' of 0.048 or less distinguishes 'low fogging' emulsions. For the red sensitive record, an 'intrinsic fog level' of 0.034 or less distinguishes 'low fogging' emulsions. It is expected that fully spectrochemically sensitized emulsions used in the most sensitive layers have been optimally sensitized both chemically and spectrally such that their response to light has been maximized at fog levels that are characterized as "normal" or else "low fogging". In addition, emulsions that have not been optimally sensitized to respond to light may meet the low intrinsic fog test, by virtue of being sensitized to achieve other properties such as maximum thermal stability upon extended keeping. These emulsions are also included in the above definition, although they are not normally considered to be fully spectrochemically sensitized.

CRC-1

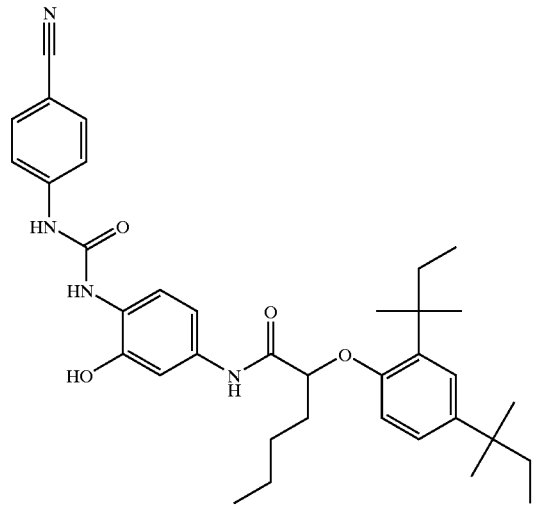

MRC-1

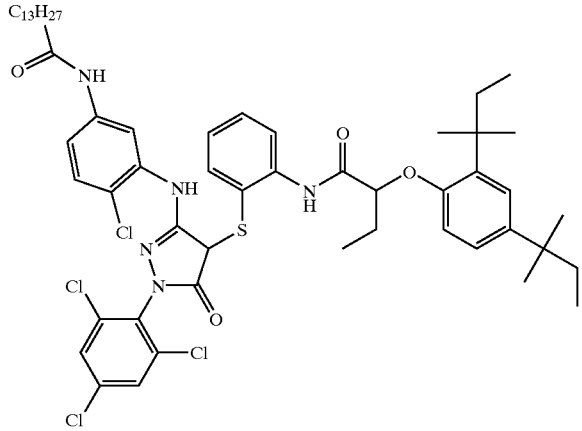

-continued

YRC-1

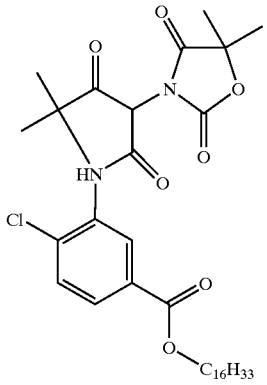

If an emulsion meets the above definition of "low fogging" it is "low fogging emulsion" regardless of the method of preparation of the emulsion. Another way to define "low fogging" is by the method of preparation of the emulsion. Emulsions prepared using the following described methods are considered to be "low fogging" whether they meet the above test or not: 1) tabular silver halide grains precipitated in a reaction vessel wherein the majority of the grain growth in the reaction vessel is performed at a pH of less than 4.0 (this includes starch precipitated emulsions as further described and traditional gelatin emulsions) and 2) tabular silver halide grains which have been precipitated in an aqueous medium containing a peptizer that is a water dispersible starch and which have been additionally precipitated in the presence of an oxidizing agent. Preferably the low pH method is utilized with starch precipitated emulsions. These methods will be described in detail below.

The silver halide grains to be used in the invention may be prepared according to methods known in the art, such as those described in *Research Disclosure*, Item 38957and James, *The Theory of the Photographic Process*. These methods generally involve mixing a water soluble silver salt with a water soluble halide salt in the presence of a protective colloid, and controlling the temperature, pAg, pH values, etc., at suitable values during formation of the silver halide by precipitation. In one embodiment of the invention the protective colloid or peptizer is a traditional gelatin peptizer.

In another embodiment of the invention the protective colloid or peptizer is water dispersible, cationic starch. The term "starch" is employed to include both natural starch and modified derivatives, such as dextrinated, hydrolyzed, alkylated, hydroxyalkylated, acetylated, or fractionated starch. The starch can be of any origin, such as cornstarch, wheat starch, potato starch, tapioca starch, sago starch, rice starch, waxy cornstarch, or high amylose cornstarch.

Starches are generally comprised of two structurally distinctive polysaccharides, α-amylose and amylopectin. Both are comprised of α-glucopyranose units. In α-amylose the α-D-glucopyranose units form a 1,4-straight chain polymer. The repeating units take the following form:

(I)

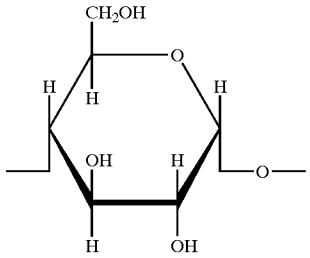

In amylopectin, in addition to the 1,4-bonding of repeating units, 6-position chain branching (at the site of the —$CH_2OH$ group above) is also in evidence, resulting in a branched chain polymer. The repeating units of starch and cellulose are diasteroisomers that impart different overall geometries to the molecules. The α anomer, found in starch and shown in formula I above, results in a polymer that is capable of crystallization and some degree of hydrogen bonding between repeating units in adjacent molecules, but not to the same degree as the β anomer repeating units of cellulose and cellulose derivatives. Polymer molecules formed by the β anomers show strong hydrogen bonding between adjacent molecules, resulting in clumps of polymer molecules and a much higher propensity for crystallization. Lacking the alignment of substituents that favors strong intermolecular bonding, found in cellulose repeating units, starch and starch derivatives are much more readily dispersed in water.

The water dispersible starches employed in the practice of the invention are cationic—that is, they contain an overall net positive charge when dispersed in water. Starches are conventionally rendered cationic by attaching a cationic substituent to the α-D-glucopyranose units, usually by esterification or etherification at one or more free hydroxyl sites. Reactive cationogenic reagents typically include a primary, secondary or tertiary amino group (which can be subsequently protonated to a cationic form under the intended conditions of use) or a quaternary ammonium, sulfonium or phosphonium group.

To be useful as a peptizer the cationic starch must be water dispersible. Many starches disperse in water upon heating to temperatures up to boiling for a short time (e.g., 5 to 30 minutes). High sheer mixing also facilitates starch dispersion. The presence of cationic substituents increases the polar character of the starch molecule and facilitates dispersion. The starch molecules preferably achieve at least a colloidal level of dispersion and ideally are dispersed at a molecular level—i.e., dissolved.

The following teachings illustrate water dispersible cationic starches within the contemplation of the invention:

*Rutenberg et al U.S. Pat. No. 2,989,520;

Meisel U.S. Pat. No. 3,017,294;

Elizer et al U.S. Pat. No. 3,051,700;

Aszolos U.S. Pat. No. 3,077,469;

Elizer et al U.S. Pat. No. 3,136,646;

*Barber et al U.S. Pat. No. 3,219,518;

*Mazzarella et al U.S. Pat. No. 3,320,080;

Black et al U.S. Pat. No. 3,320,118;

Caesar U.S. Pat. No. 3,243,426;

Kirby U.S. Pat. No. 3,336,292;

Jarowenko U.S. Pat. No. 3,354,034;

Caesar U.S. Pat. No. 3,422,087;

*Dishburger et al U.S. Pat. No. 3,467,608;

*Beaninga et al U.S. Pat. No. 3,467,647;
Brown et al U.S. Pat. No. 3,671,310;
Cescato U.S. Pat. No. 3,706,584;
Jarowenko et al U.S. Pat. No. 3,737,370;
*Jarowenko U.S. Pat. No. 3,770,472;
Moser et al U.S. Pat. No. 3,842,005;
Tessler U.S. Pat. No. 4,060,683;
Rankin et al U.S. Pat. No. 4,127,563;
Huchette et al U.S. Pat. No. 4,613,407;
Blixt et a U.S. Pat. No. 4,964,915;
*Tsai et al U.S. Pat. No. 5,227,481; and
*Tsai et al U.S. Pat. No. 5,349,089.

It is preferred to employ an oxidized cationic starch. The starch can be oxidized before (* patents above) or following the addition of cationic substituents. This is accomplished by treating the starch with a strong oxidizing agent. Both hypochlorite ($ClO^-$) or periodate ($IO_4^-$) have been extensively used and investigated in the preparation of commercial starch derivatives and preferred. While any convenient oxidizing agent counter ion can be employed, preferred counter ions are those fully compatible with silver halide emulsion preparation, such as alkali and alkaline earth cations, most commonly sodium, potassium, or calcium.

When the oxidizing agent opens the α-D-glucopyranose ring, the oxidation sites are usually at the 2- and 3-position carbon atoms forming the α-D-glucopyranose ring. The 2- and 3-position

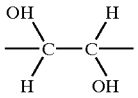

groups are commonly referred to as the glycol groups. The carbon-to-carbon bond between the glycol groups is replaced in the following manner:

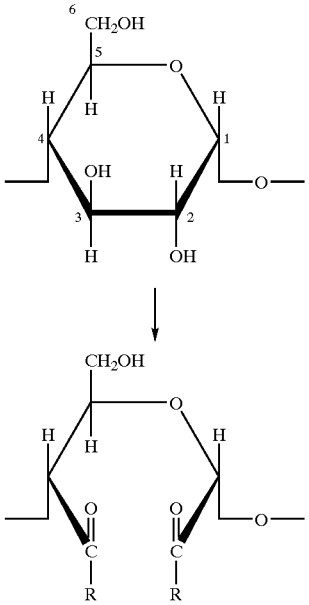

where R represents the atoms completing an aldehyde group or a carboxyl group.

The hypocblorite oxidation of starch is most extensively employed in commercial use. The hypochiorite is used in small quantities to modify impurities in starch. Any modification of the starch at these low levels is minimal, at most affecting only the polymer chain terminating aldehyde groups, rather than the α-D-glucopyranose repeating units themselves. At levels of oxidation that affect the α-D-glucopyranose repeating units the hypochlorite affects the 2, 3, and 6 positions, forming aldehyde. groups at lower levels of oxidation and carboxyl groups at higher levels of oxidation. Oxidation is conducted at mildly acidic and alkaline pH (e.g., >5 to 11). The oxidation reaction is exothermic, requiring cooling of the reaction mixture. Temperatures of less than 45° C. are preferably maintained. Using a hypobromite oxidizing agent is known to produce similar results as hypochlorite.

Hypochlorite oxidation is catalyzed by the presence of bromide ions. Since silver halide emulsions are conventionally precipitated in the presence of a stoichiometric excess of the halide to avoid inadvertent silver ion reduction (fogging), it is conventional practice to have bromide ions in the dispersing media of high bromide silver halide emulsions. Thus, it is specifically contemplated to add bromide ion to the starch prior to performing the oxidation step in the concentrations known to be useful in the high bromide {111} tabular grain emulsions—e.g., up to a pBr of 3.0.

Cescato U.S. Pat. No. 3,706,584, discloses techniques for the hypochlorite oxidation of cationic starch. Sodium bromite, sodium chlorite, and calcium hypochlorite are named as alternatives to sodium hypochlorite. Further teachings of the hypochlorite oxidation of starches is provided by the following: R. L. Whistler, E. G. Linke and S. Kazeniac, "Action of Alkaline Hypochlorite on Corn Starch Amylose and Methyl 4-O-Methyl-D-glucopyranosides", *Journal Amer. Chem. Soc.*, Vol. 78, pp. 4704–9 (1956); R. L. Whistler and R. Schweiger, "Oxidation of Amylopectin with Hypochlorite at Different Hydrogen Ion Concentrations, *Journal Amer. Chem. Soc.*, Vol. 79, pp. 6460–6464 (1957); J. Schmorak, D. Mejzler and M. Lewin, "A Kinetic Study of the Mild Oxidation of Wheat Starch by Sodium Hypochloride in the Alkaline pH Range", *Journal of Polymer Science*, Vol. XLIX, pp. 203–216 (1961), J. Schmorak and M. Lewin, "The Chemical and Physico-chemical Properties of Wheat Starch with Alkaline Sodium Hypochlorite", *Journal of Polymer Science: Part A*, Vol. 1, pp. 2601–2620 (1963); K. F. Patel, H. U. Mehta and H. C. Srivastava, "Kinetics and Mechanism of Oxidation of Starch with Sodium Hypochlorite", *Journal of Applied Polymer Science*, Vol. 18, pp. 389–399 (1974), R. L. Whistler, J. N. Bemiller and E. F. Paschall, *Starch: Chemistry and Technology*, Chapter X, Starch Derivatives: Production and Uses, II. Hypochiorite-Oxidized Starches, pp. 315–323, Academic Press, 1984; and O. B. Wurzburg, *Modified Starches: Properties and Uses*, III. Oxidized or Hypochlorite-Modified Starches, pp. 23–28 and pp. 245–246, CRC Press (1986). Although hypochlorite oxidation is normally carried out using a soluble salt, the free acid can alternatively be employed, as illustrated by M. E. McKillican and C. B. Purves, "Estimation of Carboxyl, Aldehyde and Ketone Groups in Hypochlorous Acid Oxystarches", *Can. J. Chem.*, Vol. 312–321 (1954).

Periodate oxidizing agents are of particular interest, since they are known to be highly selective. The periodate oxidizing agents produce starch dialdehydes by the reaction shown in the formula (II) above without significant oxidation at the site of the 6 position carbon atom. Unlike hypochlorite oxidation, periodate oxidation does not produce carboxyl groups and does not produce oxidation at the 6 position. Mehltretter U.S. Pat. No. 3,251,826 discloses the use of periodic acid to produce a starch dialdehyde which is subsequently modified to a cationic form. Mehltretter also discloses for use as oxidizing agents the soluble salts of periodic acid and chlorine. Further teachings of the periodate oxidation of starches is provided by the following: V. C. Barry and P. W. D. Mitchell, "Properties of Periodate-oxidized Polysaccharides. Part II. The Structure of some Nitrogen-containing Polymers", *Journal Amer. Chem. Soc.*, 1953, pp. 3631–3635; P. J. Borchert and J. Mirza, "Cationic Dispersions of Dialdehyde Starch I. Theory and Preparation", *Tappi*, Vol. 47, No. 9, pp. 525–528 (1964); J. E. McCormick, "Properties of Periodate-oxidized Polysaccharides. Part VII. The Structure of Nitrogen-containing Derivatives as deduced from a Study of Monosaccharide Analogues", *Journal Amer. Chem. Soc.*, pp. 2121–2127 (1966); and O. B. Wurzburg, *Modified Starches: Properties and Uses*, III. Oxidized or Hypochlorite-Modified Starches, pp. 28–29, CRC Press (1986).

Starch oxidation by electrolysis is disclosed by F. F. Farley and R. M. Hixon, "Oxidation of Raw Starch Granules by Electrolysis in Alkaline Sodium Chloride Solution", *Ind. Eng. Chem.*, Vol. 34, pp. 677–681 (1942).

Depending upon the choice of oxidizing agents employed, one or more soluble salts may be released during the oxidation step. Where the soluble salts correspond to or are similar to those conventionally present during silver halide precipitation, the soluble salts need not be separated from the oxidized starch prior to silver halide precipitation. It is, of course, possible to separate soluble salts from the oxidized cationic starch prior to precipitation using any conventional separation technique. For example, removal of halide ion in excess of that desired to be present during grain precipitation can be undertaken. Simply decanting solute and dissolved salts from oxidized cationic starch particles is a simple alternative. Washing under conditions that do not solubilize the oxidized cationic starch is another preferred option. Even if the oxidized cationic starch is dispersed in a solute during oxidation, it can be separated using conventional ultrafiltration techniques, since there is a large molecular size separation between the oxidized cationic starch and soluble salt by-products of oxidation.

The carboxyl groups formed by oxidation take the form —C(O)OH, but, if desired, the carboxyl groups can, by further treatment, take the form —C(O)OR', where R' represents the atoms forming a salt or ester. Any organic moiety added by esterification preferably contains from 1 to 6 carbon atoms and optimally from 1 to 3 carbon atoms.

The minimum degree of oxidation contemplated is that required to reduce the viscosity of the starch. It is generally accepted (see citations above) that opening an α-D-glucopyranose ring in a starch molecule disrupts the helical configuration of the linear chain of repeating units which in turn reduces viscosity in solution. It is contemplated that at least one α-D-glucopyranose repeating unit per starch polymer, on average, be ring opened in the oxidation process. As few as two or three opened α-D-glucopyranose rings per polymer has a profound effect on the ability of the starch polymer to maintain a linear helical configuration. It is generally preferred that at least 1 percent of the glucopyranose rings be opened by oxidation.

A preferred objective is to reduce the viscosity of the cationic starch by oxidation to less than four times (400 percent of) the viscosity of water at the starch concentrations employed in silver halide precipitation. Although this viscosity reduction objective can be achieved with much lower levels of oxidation, starch oxidations of up to 90 percent of the α-D-glucopyranose repeating units have been reported (Wurzburg, cited above, p. 29). A typical convenient range of oxidation ring-opens from 3 to 50 percent of the α-D-glucopyranose rings.

The water dispersible cationic starch is present during the precipitation (during nucleation and grain growth or during grain growth) of the high bromide tabular grains. Preferably precipitation is conducted by substituting the water dispersible cationic starch for all conventional gelatino-peptizers. In substituting the selected cationic starch peptizer for conventional gelatino-peptizers, the concentrations of the selected peptizer and the point or points of addition can correspond to those employed using gelatino-peptizers.

In addition, it has been unexpectedly discovered that emulsion precipitation can tolerate even higher concentrations of the selected peptizer. For example, it has been observed that all of the selected peptizer required for the preparation of an emulsion through the step of chemical sensitization can be present in the reaction vessel prior to grain nucleation. This has the advantage. that no peptizer additions need be interjected after tabular grain precipitation has commenced. It is generally preferred that from 1 to 500 grams (most preferably from 5 to 100 grams) of the selected peptizer per mole of silver to be precipitated be present in the reaction vessel prior to tabular grain nucleation.

At the other extreme it is, of course, well known, as illustrated by Mignot U.S. Pat. No. 4,334,012, that no peptizer is required to be present during grain nucleation and, if desired, addition of the selected peptizer can be deferred until grain growth has progressed to the point that peptizer is actually required to avoid tabular grain agglomeration.

The procedures for high bromide {111} tabular grain emulsion preparation through the completion of tabular grain growth require only the substitution of the selected peptizer for conventional gelatino-peptizers. The following high bromide {111} tabular grain emulsion precipitation procedures, are specifically contemplated to be useful in the practice of the invention for the use of gelatin as a peptizer and for the starch peptizer modifications discussed above:

Daubendiek et al U.S. Pat. No. 4,414,310;
Abbott et al U.S. Pat. No. 4,425,426;
Wilgus et al U.S. Pat. No. 4,434,226;
Maskasky U.S. Pat. No. 4,435,501;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;

Antoniades et al U.S. Pat. No. 5,250,403;

Kim et al U.S. Pat. No. 5,272,048;

Delton U.S. Pat. No. 5,310,644;

Chang et al U.S. Pat. No. 5,314,793;

Sutton et al U.S. Pat. No. 5,334,469;

Black et al U.S. Pat. No. 5,334,495;

Chaffee et al U.S. Pat. No. 5,358,840; and

Delton U.S. Pat. No. 5,372,927.

The high bromide tabular grain emulsions, preferably {111} tabular emulsions, that are formed contain at least 50 mole percent, more preferably 70 mole percent bromide, and optimally at least 90 mole percent, based on silver. Silver bromide, silver iodobromide, silver chlorobromide, silver iodochlorobromide, and silver chloroiodobromide tabular grain emulsions are specifically contemplated. Although silver chloride and silver bromide form tabular grains in all proportions, chloride is preferably present in concentrations of 30 mole percent, based on silver, or less. Iodide can be present in the tabular grains up to its solubility limit under the conditions selected for tabular grain precipitation. Under ordinary conditions of precipitation silver iodide can be incorporated into the tabular grains in concentrations ranging up to about 40 mole percent, based on silver. It is generally preferred that the iodide concentration be less than 20 mole percent, based on silver. Typically the iodide concentration is less than 10 mole percent, based on silver, and more preferably less than 6 mole percent, based on silver. To facilitate rapid processing, such as commonly practiced in radiography, it is preferred that the iodide concentration be limited to less than 4 mole percent, based on silver. Significant photographic advantages can be realized with iodide concentrations as low as 0.5 mole percent, based on silver, with an iodide concentration of at least 1 mole percent, based on silver, being preferred.

High bromide {111} tabular grain emulsions precipitated in the presence of a cationic starch are disclosed in the following patents: Maskasky U.S. Pat. Nos. 5,604,085; 5,620,840; 5,667,955; 5,691,131; and 5,733,718.

As noted above, one method of preparing a "low fogging" emulsion is wherein the majority (i.e., at least 50 mole percent) of grain growth during emulsion grain precipitation in the reaction vessel, and preferably precipitation of greater than 70 mole % (more prefereably greater than 90 mole %) of the emulsion grains based on total silver, is performed at a relatively low pH of less than 4.0, preferably less than or equal to 3.5, more preferably less than or equal to 3.0, more preferably less than or equal to 2.5 and most preferably less than or equal to 2.0. This low pH precipitation method may be used with either conventional gelatin peptizers or with starch peptizers. Preferably it is utilized with starch peptizers. While the use of a low pH environment with starch peptizers during grain growth may result in starch hydrolysis leading to the formation of additional aldehyde groups (which are believed to reduce silver ions to generate fog silver centers in emulsion grains), growth of high bromide silver halide emulsion grains at low pH in the presence of a starch peptizer has surprisingly resulted in fewer fog generating grains, even in the absence of use of a strong oxidizing agent during emulsion grain precipitation as was previously thought required to oxidize silver fog centers as they are formed. Maintenance of a low pH environment during grain growth in accordance with the invention is believed to sufficiently suppress the silver ion reduction reaction such that silver centers are not formed at photographically harmful levels, leading to low fog emulsions. As such, in accordance with preferred embodiments of the invention, the addition or generation of strong oxidizing agents in the reaction vessel during grain growth is not needed. While establishing a relatively low pH value is advantageous during grain growth, extremely low pH would be expected to degrade the starch peptizer, therefore a pH value of at least 1.0 is also preferred. Methods of preparing silver bromide emulsions under low pH conditions are described in U.S. application Ser. Nos. 09/731,454 and 09/731,446 of Maskasky, both filed Dec. 7, 2000, the entire disclosures of which are incorporated herein by reference.

The high bromide emulsion which are precipitated at low pH in accordance with the invention may be stored until they are chemically or spectrally sensitized. In preferred embodiments of the invention, such storage is performed at similarly low pH to prevent generation of fog silver centers after precipitation. After sensitization, added dyes and conventional antifoggants may provide fog protection at conventional higher pH storage conditions of 5 and above.

The second method of preparing "low fogging" emulsions is utilized with starch peptized emulsions. In this method the emulsion is treated with an oxidizing agent, which is capable of oxidizing metallic silver, during or subsequent to grain precipitation. Preferred oxidizing agents are those that in their reduced form have little or no impact on the performance properties of the emulsions in which they are incorporated. Strong oxidizing agents such as those noted above to be useful in oxidizing cationic starch, such as hypochlorite ($ClO^-$) or periodate ($IO_4^-$), are specifically contemplated. Specifically preferred oxidizing agents are halogen—e.g., bromine ($Br_2$) or iodine ($I_2$). When bromine or iodine is used as an oxidizing agent, the bromine or iodine is reduced to $Br^-$ or $I^-$. These halide ions can remain with other excess halide ions in the dispersing medium of the emulsion or be incorporated within the grains without adversely influencing photographic performance. Any level of oxidizing agent can be utilized that is effective in reducing minimum density. Concentrations of oxidizing agent added to the emulsion as low as about $1\times10^{-6}$ mole per Ag mole are contemplated. Since very low levels of $Ag^\circ$ are responsible for increases in minimum density, no useful purpose is served by employing oxidizing agent concentrations of greater than 0.1 mole per Ag mole. A specifically preferred oxidizing agent range is from $1\times10^{-4}$ to $1\times10^{-2}$ mole per Ag mole. The silver basis is the total silver at the conclusion of precipitation of the high bromide {111} tabular grain emulsion, regardless of whether the oxidizing agent is added during or after precipitation.

Conventional dopants can be incorporated into the tabular grains during their precipitation, as illustrated by the patents cited above and *Research Disclosure*, Item 38957, Section I. Emulsion grains and their preparation, D. Grain modifying conditions and adjustments, paragraphs (3), (4) and (5). It is specifically contemplated to incorporate shallow electron trapping (SET) site providing dopants in the tabular grains, further disclosed in *Research Disclosure*, Vol. 367, November 1994, Item 36736, and Olm et al U.S. Pat. No. 5,576,171.

It is also recognized that silver salts can be epitaxially grown onto the tabular grains during the precipitation process. Epitaxial deposition onto the edges and/or corners of tabular grains is specifically taught by Maskasky U.S. Pat. No. 4,435,501 and Daubendiek et al U.S. Pat. Nos. 5,573,902 and 5,576,168.

Although epitaxy onto the host tabular grains can itself act as a sensitizer, the emulsions of the invention show sensitivity enhancements with or without epitaxy when chemically sensitized employing one or a combination of noble metal, middle chalcogen (sulfur, selenium and/or tellurium) and reduction chemical sensitization techniques. Conventional chemical sensitizations by these techniques are summarized in *Research Disclosure*, Item 38957, cited above, Section IV. Chemical sensitizations. It is preferred to employ at least one of noble metal (typically gold) and middle chalcogen (typically sulfur) and, most preferably, a combination of both in preparing the emulsions of the invention for photographic use. The use of a cationic starch peptizer allows distinct advantages relating to chemical sensitization to be realized. Under comparable levels of chemical sensitization higher photographic speeds can be realized using cationic starch peptizers. When comparable photographic speeds are sought, a cationic starch peptizer in the absence of gelatin allows lower levels of chemical sensitizers to be employed and results in better incubation keeping. When chemical sensitizer levels remain unchanged, speeds equal to those obtained using gelatino-peptizers can be achieved at lower precipitation and/or sensitization temperatures, thereby avoiding unwanted grain ripening.

Between emulsion precipitation and chemical sensitization, the step that is preferably completed before any gelatin or gelatin derivative is added to the emulsion, it is conventional practice to wash the emulsions to remove soluble reaction by-products (e.g., alkali and/or alkaline earth cations and nitrate anions). If desired, emulsion washing can be combined with emulsion precipitation, using ultrafiltration during precipitation as taught by Mignot U.S. Pat. No. 4,334,012. Alternatively emulsion washing by diafiltration after precipitation and before chemical sensitization can be undertaken with a semipermeable membrane as illustrated by *Research Disclosure*, Vol. 102, October 1972, Item 10208, Hagemaier et al *Research Disclosure*, Vol. 131, March 1975, Item 13122, Bonnet *Research Disclosure*, Vol. 135, July 1975, Item 13577, Berg et al German OLS 2,436,461 and Bolton U.S. Pat. No. 2,495,918, or by employing an ion-exchange resin, as illustrated by Maley U.S. Pat. No. 3,782,953 and Noble U.S. Pat. No. 2,827,428. In washing by these techniques there is no possibility of removing the selected peptizers, since ion removal is inherently limited to removing much lower molecular weight solute ions.

Fragmentable electron donating sensitizers are particularly useful with this invention. The fragmentable electron donating sensitizer provides additional speed when used in place of one, some or all conventional chemical sensitizers or in combination with these sensitizers. It is common practice in chemically sensitizing gelatio-peptized emulsions to hold the emulsions for a period of time at an elevated temperature to effect chemical sensitization. The FED sensitizer can be added before heating when the sensitizer is sufficiently stable to withstand the elevated temperature without fragmenting. However, where a heating step is contemplated to effect a conventional chemical sensitization, it is preferred to add the FED sensitizer at the conclusion of the heating step. One of the significant advantages of this invention is that the oxidized cationic starch peptized emulsions can be efficiently chemically sensitized with conventional sensitizers at lower temperatures. For example, chemical sensitization can be achieved at temperatures lower than those required for the sensitization of corresponding gelatino-peptized emulsions. It is possible to achieve chemical sensitization of oxidized cationic starch peptized tabular grain emulsions by heating to temperatures of <40° C. Thus, the FED sensitizer can be added before, during or after addition of any other, conventional chemical sensitizers.

Fragmentable electron donating (FED) sensitizers of the types disclosed by Farid et al U.S. Pat. Nos. 5,747,235; 5,7547,236; and 6,153,371; in Lenhard et al U.S. Pat. No. 6,010,841; in Gould et al U.S. Pat. No. 5,994,051; and in Adin et al U.S. Pat. Nos. 6,054,260 and 6,306,570, the disclosures of which are hereby incorporated by reference, are specifically contemplated for use in the practice of this invention.

These FED sensitizers satisfy the formula X—Y', X—Y' forming the entire sensitizer or a moiety-X—Y' of the sensitizer, wherein X is an electron donating compound moiety;

Y' is a proton or a leaving group Y; and wherein:

(1) X—Y' has an oxidation potential between 0 and about 1.4 V; and (2) the oxidized form of X—Y' undergoes a bond cleavage reaction to give the radical X* and the leaving fragment Y'; and, optionally, (3) the radical X* has an oxidation potential $\leqq -0.7$V (that is, equal to or more negative than about −0.7V).

In embodiments of the invention wherein Y' is a proton, a base, $\beta^-$, is covalently linked directly or indirectly to X.

Compounds wherein X—Y' meets criteria (1) and (2) but not (3) are capable of donating one electron and are referred to herein as fragmentable one-electron donating compounds. Compounds which meet all three criteria are capable of donating two electrons and are referred to herein as fragmentable two-electron donating compounds.

In this patent application, oxidation potentials are reported as "V" which represents volts versus a saturated calomel reference electrode.

In embodiments of the invention in which Y' is Y, the following represents the reactions that are believed to take place when X—Y undergoes oxidation and fragmentation to produce a radical X*, which in a preferred embodiment undergoes further oxidation.

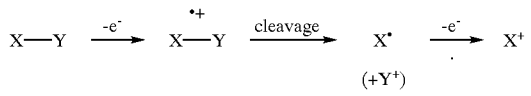

Electron elimination from compound X—Y occurs when the oxidation potential of X—Y is equal to or more negative than 1.4 volts. Electron elimination from the free radical X* occurs when X* exhibits an oxidation potential equal to or more negative than −0.7 volt.

The structural features of X—Y are defined by the characteristics of the two parts, namely the fragment X and the fragment Y. The structural features of the fragment X determine the oxidation potential of the X—Y molecule and that of the radical X*, whereas both the X and Y fragments affect the fragmentation rate of the oxidized molecule $X—Y^{*+}$.

In embodiments of the invention in which Y' is H, the following represents the reactions believed to take place when the compound X—H undergoes oxidation and deprotonation to the base, $\beta^-$, to produce a radical X*, which in a preferred embodiment undergoes further oxidation.

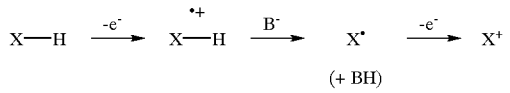

Preferred X groups are of the general formula:

(VI)

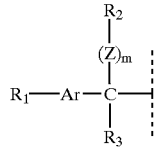

(VII)

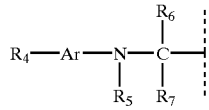

-continued (VIII)

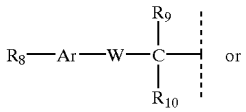

(IX)

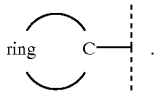

The symbol "R" (that is, R without a subscript) is used in all structural formulae in this patent application to represent a hydrogen atom or an unsubstituted or substituted alkyl group.

In structure (VI):

m=0, 1;

Z=O, S, Se, or Te;

Ar=aryl group (e.g., phenyl, naphthyl, phenanthryl, anthryl); or heterocyclic group (e.g., pyridine, indole, benzimidazole, thiazole, benzothiazole, thiadiazole, etc.)

$R_1$=R, carboxyl, amide, sulfonamide, halogen, $NR_2$, $(OH)_n$, $(OR')_n$, or $(SR)_n$;

R'=alkyl or substituted alkyl;

n=1–3;

$R_2$=R, or Ar';

$R_3$=R, or Ar';

$R_2$ and $R_3$ together can form a 5- to 8-membered ring;

$R_2$ and Ar= can be linked to form a 5- to 8-membered ring;

$R_3$ and Ar= can be linked to form a 5- to 8-membered ring;

Ar'=aryl group such as phenyl, substituted phenyl, or heterocyclic group (e.g., pyridine, benzothiazole, etc.)

R=a hydrogen atom or an unsubstituted or substituted alkyl group.

In structure (VII):

Ar=aryl group (e.g., phenyl, naphthyl, phenanthryl); or heterocyclic group (e.g., pyridine, benzothiazole, etc.);

$R_4$=a substituent having a Hammett sigma value of −1 to +1, preferably −0.7 to +0.7, e.g., R, OR, SR, halogen, CHO, C(O)R, COOR, $CONR_2$, $SO_3R$, $SO_2NR_2$, $SO_2R$, SOR, C(S)R, etc;

$R_5$=R, or Ar'

$R_6$ and $R_7$=R, or Ar'

$R_5$ and Ar= can be linked to form a 5- to 8-membered ring;

$R_6$ and Ar= can be linked to form a 5- to 8-membered ring (in which case, $R_6$ can be a hetero atom);

$R_5$ and $R_6$ can be linked to form a 5- to 8-membered ring;

$R_6$ and $R_7$ can be linked to form a 5- to 8-membered ring;

Ar'=aryl group such as phenyl, substituted phenyl, heterocyclic group;

R=hydrogen atom or an unsubstituted or substituted alkyl group.

A discussion on Hammett sigma values can be found in C. Hansch and R. W. Taft *Chem. Rev.* Vol 91, (1991) p 165, the disclosure of which is incorporated herein by reference.

In structure (VIII):

W=O, S, or Se;

Ar=aryl group (e.g., phenyl, naphthyl, phenantbryl, anthryl), or heterocyclic group (e.g., indole, benzimidazole, etc.)

$R_8$=R, carboxyl, $NR_2$, $(OR)_n$, or $(SR)_n$ (n=1–3);

$R_9$ and $R_{10}$=R, or Ar';

$R_9$ and Ar= can be linked to form a 5- to 8-membered ring;

Ar'=aryl group such as phenyl substituted phenyl or heterocyclic group;

R=a hydrogen atom or an unsubstituted or substituted alkyl group.

In structure (IX):

"ring" represents a substituted or unsubstituted 5-, 6-, or 7-membered unsaturated ring, preferably a heterocyclic ring.

The following are illustrative examples of the group X of the general structure VI.

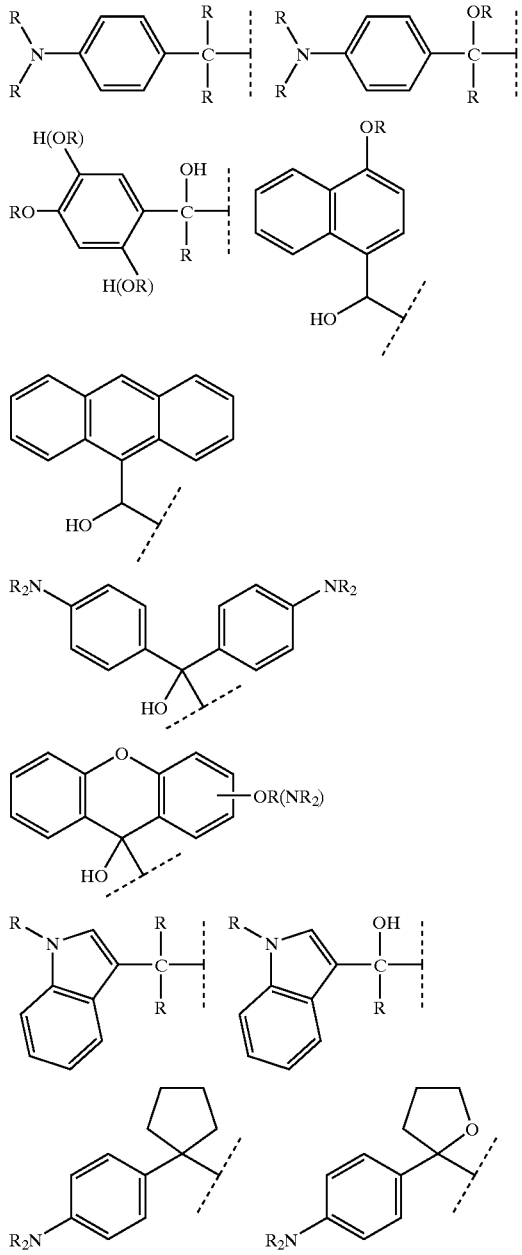

-continued

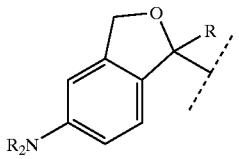

In the structures of this patent application a designation such as —OR($NR_2$) indicates that either —OR or —$NR_2$ can be present.

The following are illustrative examples of the group X of general structure VII:

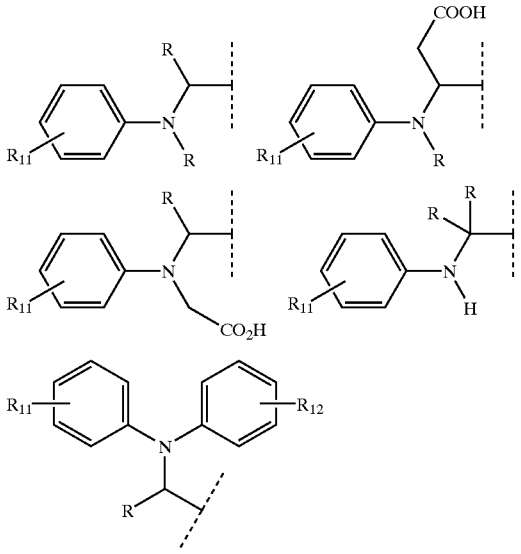

$R_{11}$ and $R_{12}$ =

| | |
|---|---|
| H | carboxyl |
| alkyl | amido |
| alkoxy | formyl |
| alkylthio | sulfonyl |
| halo | sulfonamido |
| carbamoyl | nitrile |

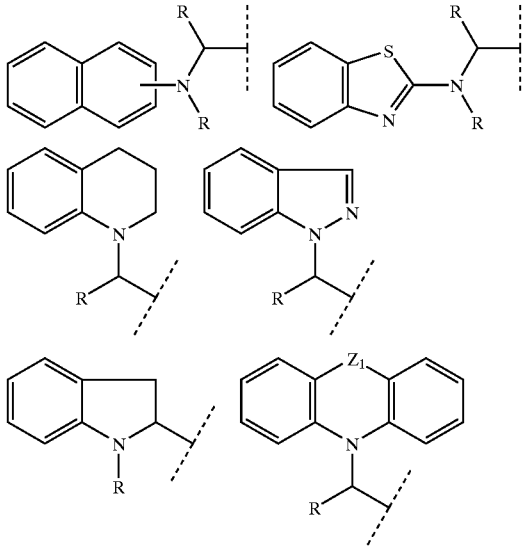

$Z_1$=a covalent bond, S, O, Se, NR, $CR_2$, CR=CR, or $CH_2CH_2$.

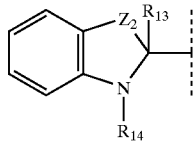

$Z_2$=S, O, Se, NR, $CR_2$, CR=CR, $R_{13}$,=alkyl, substituted alkyl or aryl, and $R_{14}$=H, alkyl substituted alkyl or aryl.

The following are illustrative examples of the group X of the general structure VIII:

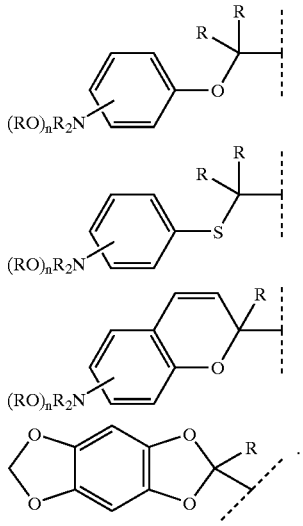

n = 1–3

The following are illustrative examples of the group X of the general structure IX:

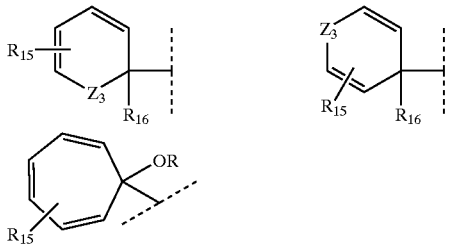

$Z_3$ = O, S, Se, NR
$R_{15}$ = R, OR, $NR_2$
$R_{16}$ = alkyl, substituted alkyl.

Preferred Y' groups are:

(1) X', where X' is an X group as defined in structures I–IV and may be the same as or different from the X group to which it is attached;

(2)

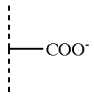

-continued (3)

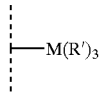

where M = Si, Sn or Ge; and R' = alkyl or substituted alkyl;

(4)

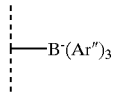

where Ar'' = aryl or substituted aryl (5)

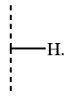

In preferred embodiments of this invention Y' is —H, —COO or —Si(R')$_3$ or —X'. Particularly preferred Y' groups are —H, —COO$^-$ or —Si(R')$_3$.

In embodiments of the invention in which Y' is a proton, a base, β$^-$, is covalently linked directly or indirectly to X. The base is preferably the conjugate base of an acid of pKa between about 1 and about 8, preferably about 2 to about 7. Collections of pKa values are available (see, for example: *Dissociation Constants of Organic Bases in Aqueous Solution*, D. D. Peril (Butterworths, London, 1965); *CRC Handbook of Chemistry and Physics*, 77th ed, D. R. Lide (CRC Press, Boca Raton, Fla., 1996)). Examples of useful bases are included in Table I.

TABLE I

| pKa's in water of the conjugate acids of some useful bases | |
|---|---|
| $CH_3—CO_2^-$ | 4.76 |
| $C_2H_5—CO_2^-$ | 4.87 |
| $(CH_3)_2CH—CO_2^-$ | 4.84 |
| $(CH_3)_3C—CO_2^-$ | 5.03 |
| $HO—CH_2—CO_2^-$ | 3.83 |
| 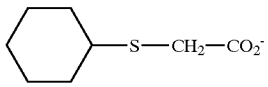 | 3.48 |
| $CH_3—CO—NH—CH_2—CO_2^-$ | 3.67 |
| 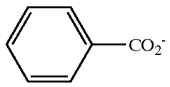 | 4.19 |
| 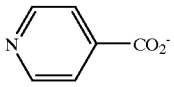 | 4.96 |
| $CH_3—COS^-$ | 3.33 |
| 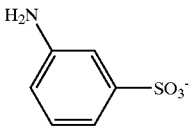 | 3.73 |
| 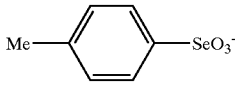 | 4.88 |
| 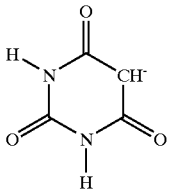 | 4.01 |
| 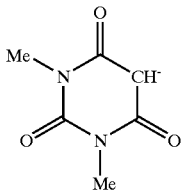 | 4.7 |
| $(CH_3)_3\overset{+}{N}—\overset{-}{O}$ | 4.65 |
| $H_2N—CH_2—CH(CH_3)—\overset{+}{N}H_3$ | 6.61 |
| 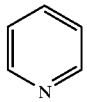 | 5.25 |
| 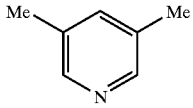 | 6.15 |
| 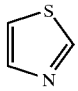 | 2.44 |
| 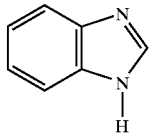 | 5.53 |

Preferably the base, β$^-$, is a carboxylate, sulfate or amine oxide.

In some embodiments of the invention, the fragmentable electron donating sensitizer contains a light absorbing group, Z, which is attached directly or indirectly to X, a silver halide absorptive group, A, directly or indirectly attached to X, or a chromophore forming group, Q, which is attached to X. Such fragmentable electron donating sensitizers are preferably of the following formulae:

$Z—(L—X—Y')_k$ $A—(L—X—Y')_k$ $(A—L)_k—X—Y'$ $Q—X—Y'$ $A—(X—Y')_k$ $(A)_k$—X—Y'

$Z—(X—Y')_k$ or $(Z)_k$—X—Y'

Z is a light absorbing group;

k is 1 or 2;

A is a silver halide adsorptive group that contains at least one atom of N, S, P, Se, or Te that promotes adsorption to silver halide;

L represents a linking group containing at least one C, N, S, P or O atom; and

Q represents the atoms necessary to form a chromophore comprising an amidinium-ion, a carboxyl-ion, or dipolar-amidic chromophoric system when conjugated with X—Y'.

Z is a light absorbing group including, for example, cyanine dyes, complex cyanine dyes, merocyanine dyes, complex merocyanine dyes, homopolar cyanine dyes, styryl dyes, oxonol dyes, hemioxonol dyes, and hemicyanine dyes.

Preferred Z groups are derived from the following dyes:

Dye 1

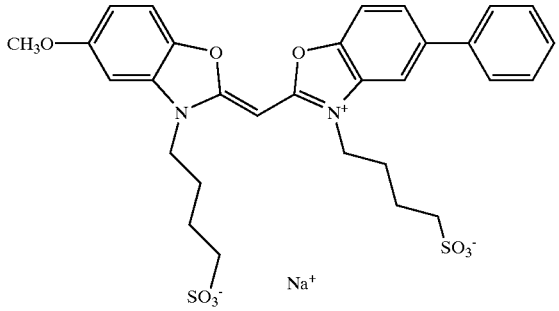

Dye 2

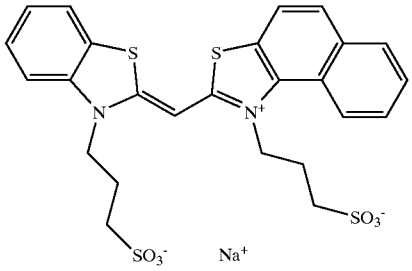

Dye 3

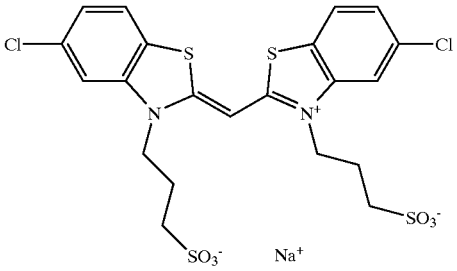

-continued

Dye 4

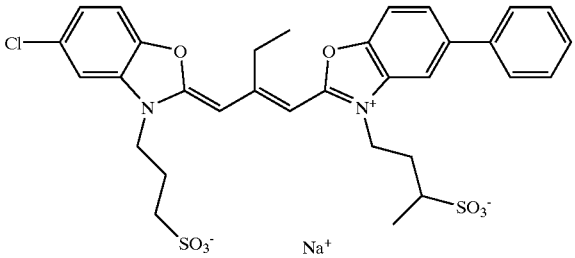

Dye 5

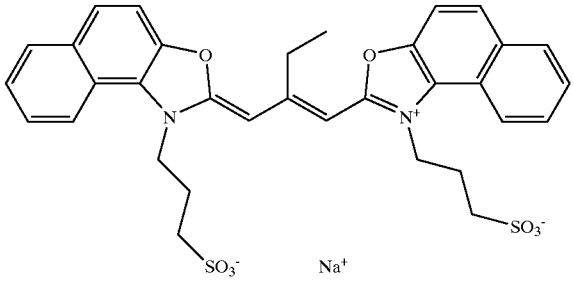

Dye 6

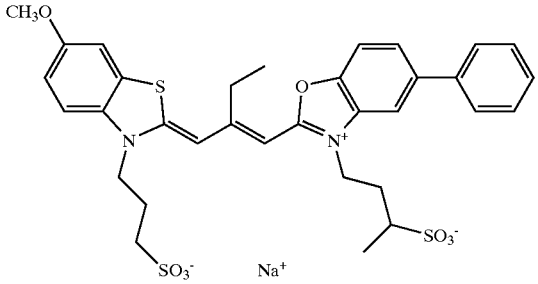

Dye 7

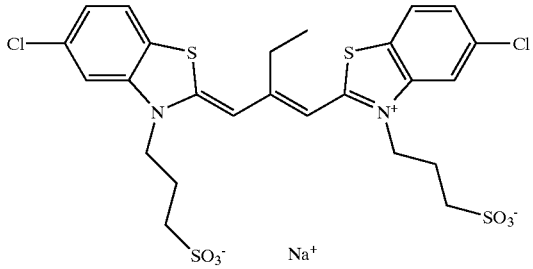

and

Dye 8

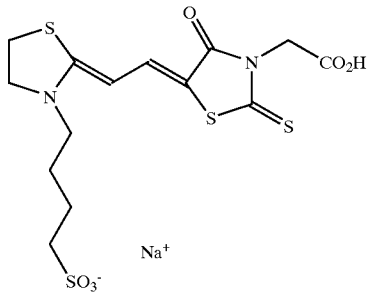

The linking group L may be attached to the dye at one (or more) of the heteroatoms, at one (or more) of the aromatic or heterocyclic rings, or at one (or more) of the atoms of the polymethine chain, at one (or more) of the heteroatoms, at one (or more) of the aromatic or heterocyclic rings, or at one (or more) of the atoms of the polymethine chain. For simplicity, and because of the multiple possible attachment sites, the attachment of the L group is not specifically indicated in the generic structures.

The silver halide adsorptive group A is preferably a silver-ion ligand moiety or a cationic surfactant moiety. In preferred embodiments, A is selected from the group consisting of: i) sulfur acids and their Se and Te analogs; ii) nitrogen acids; iii) thioethers and their Se and Te analogs; iv) phosphines; v) thionamides, selenamides, and telluramides; and vi) carbon acids.

Illustrative A groups include:

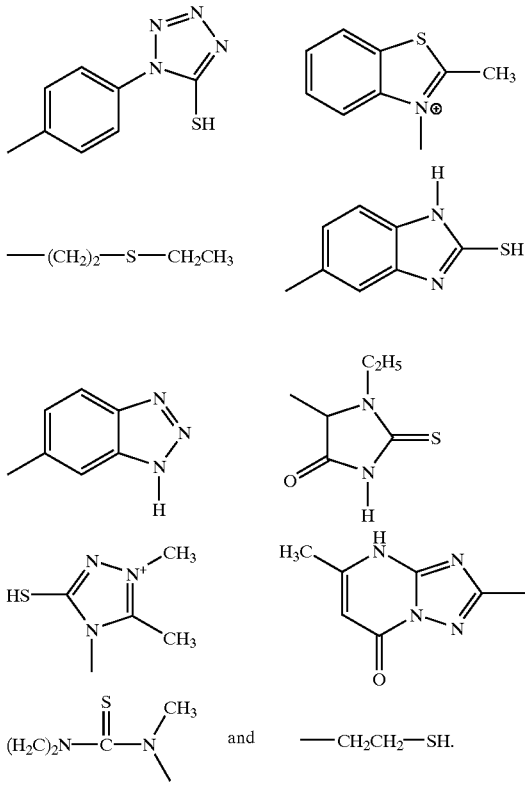

The point of attachment of the linking group L to the silver halide adsorptive group A will vary depending on the structure of the adsorptive group, and may be at one (or more) of the heteroatoms, at one (or more) of the aromatic or heterocyclic rings.

The linkage group represented by L which connects the light absorbing group to the fragmentable electron donating group XY by a covalent bond is preferably an organic linking group containing a least one C, N, S, or O atom. It is also desired that the linking group not be completely aromatic or unsaturated, so that a pi-conjugation system cannot exist between the Z and XY moieties. Preferred examples of the linkage group include an alkylene group, an arylene group, —O—, —S—, —C═O, —$SO_2$—, —NH—, —P═O, and —N═. Each of these linking components can be optionally substituted and can be used alone or in combination. Examples of preferred combinations of these groups are:

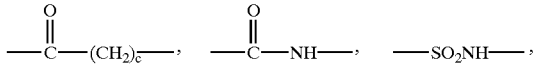

-continued

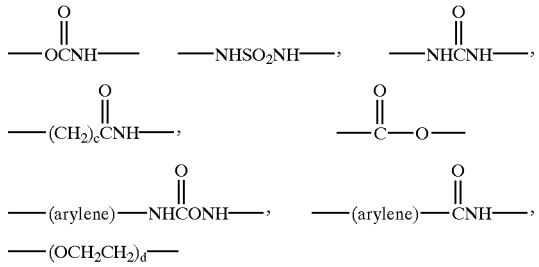

where c = 1–30, and d = 1–10.

The length of the linkage group can be limited to a single atom or can be much longer, for instance up to 30 atoms in length. A preferred length is from about 2 to 20 atoms, and most preferred is 3 to 10 atoms. Some preferred examples of L can be represented by the general formulae indicated below:

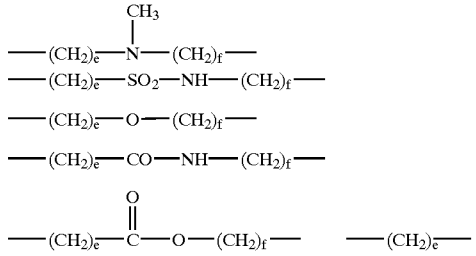

e and f = 1–30, with the proviso that e + f ≤ 30

Q represents the atoms necessary to form a chromophore comprising an amidinium-ion, a carboxyl-ion or dipolar-amidic chromophoric system when conjugated with X—Y'. Preferably the chromophoric system is of the type generally found in cyanine, complex cyanine, hemicyanine, merocyanine, and complex merocyanine dyes as described in F. M. Hamer, *The Cyanine Dyes and Related Compounds* (Interscience Publishers, New York, 1964).

Illustrative Q groups include:

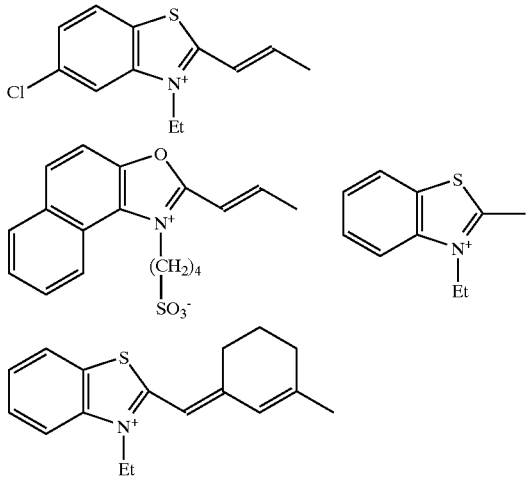

-continued

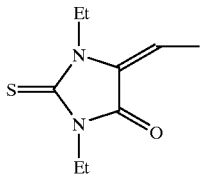

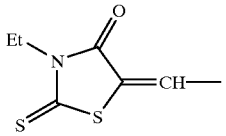

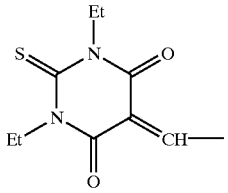

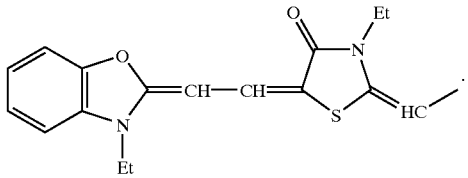

Particularly preferred are Q groups of the formula:

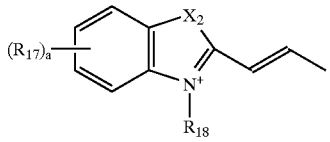

wherein:

$X_2$ is O, S, N, or $C(R_{19})_2$, where $R_{19}$ is substituted or unsubstituted alkyl;

each $R_{17}$ is independently a hydrogen atom, a halogen atom, a substituted or unsubstituted alkyl group, or substituted or unsubstituted aryl group;

a is an integer of 1–4; and $R_{18}$ is substituted or unsubstituted alkyl, or substituted or unsubstituted aryl.

Illustrative fragmentable electron donating sensitizers include:

FED 1

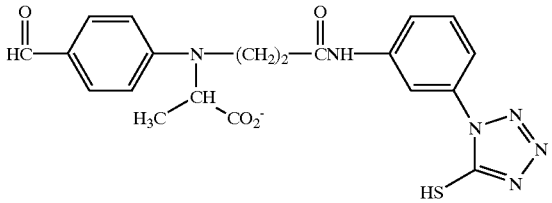

FED 2

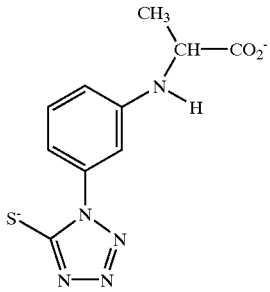

FED 3

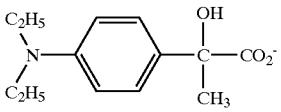

FED 4

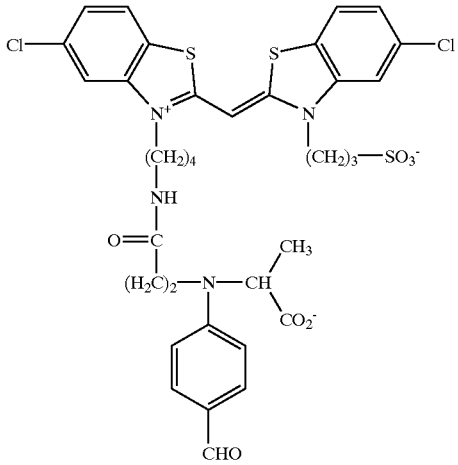

FED 5

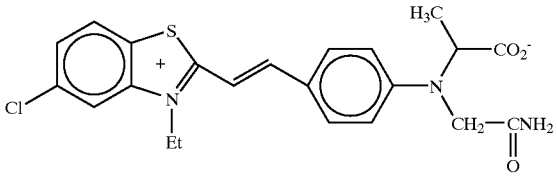

-continued
FED 6
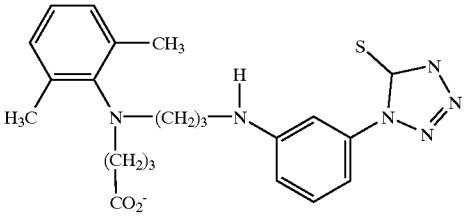
FED 7
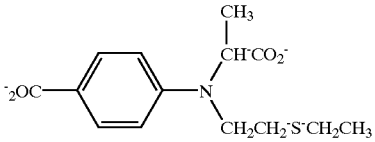
FED 8
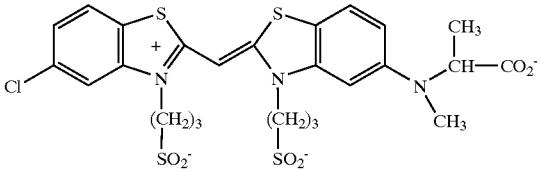
FED 9
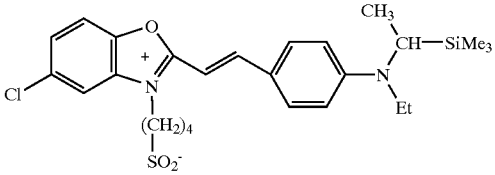
FED 10
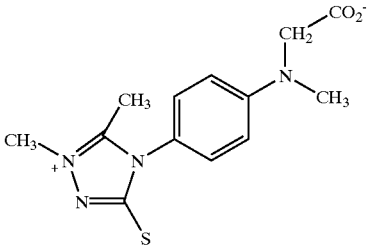
FED 11
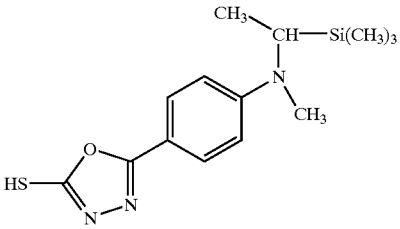
FED 12
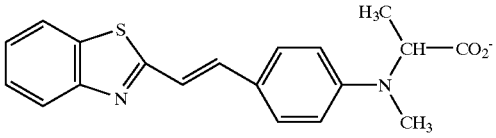
FED 13
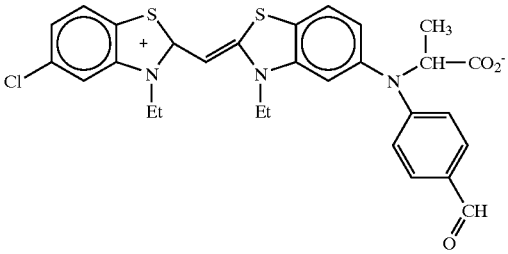
FED 14
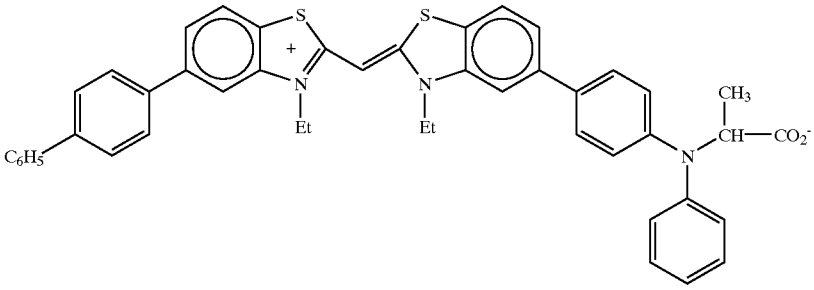

-continued

FED 15

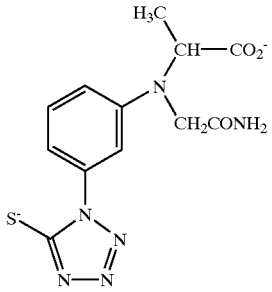

FED 16

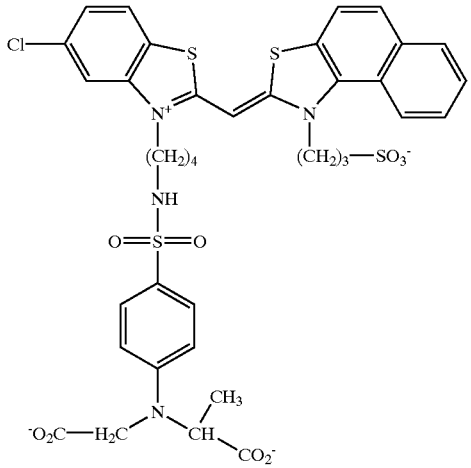

FED 17

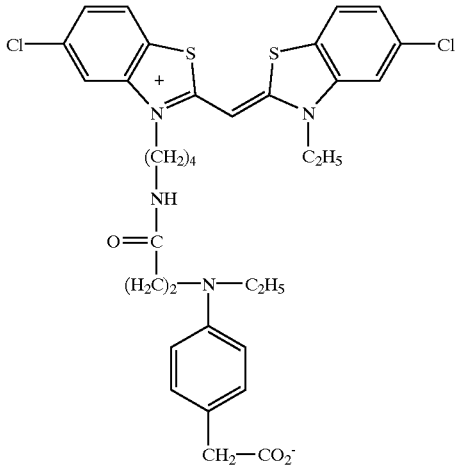

FED 18

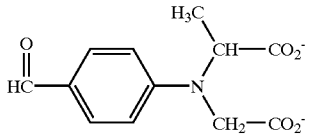

FED 19

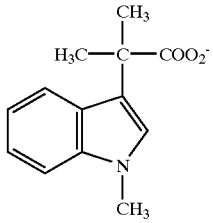

FED 20

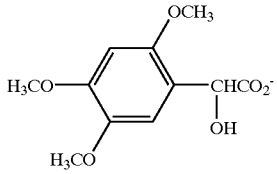

FED 21

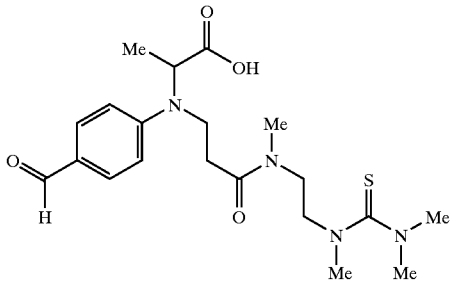

FED 22

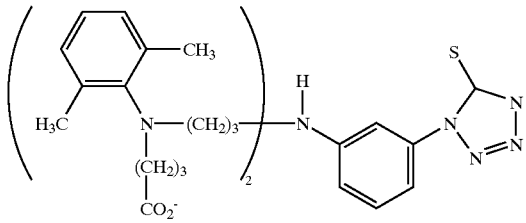

In a preferred form of the invention one or more spectral sensitizing dyes are adsorbed to the surfaces of the high bromide {111} tabular grains. In one specifically preferred form of the invention, the FED sensitizer includes a dye chromophore, providing the photon capture capability of a spectral sensitizing dye and the additional electron injection capability of a FED sensitizer. This allows a dye chromophore containing FED sensitizer to be substituted for a conventional spectral sensitizing dye. Spectral sensitizing dyes of conventional types and in conventional amounts are contemplated for use with the FED sensitizers. A FED sensitizer containing a chromophore, when employed in combination with one or more conventional spectral sensitizing dyes, can be chosen to absorb light in the same spectral region or a different spectral region than the conventional spectral sensitizing dye. As previously noted, a summary of spectral sensitizing dyes is provided by *Research Disclosure*, Item 38957, V. Spectral sensitization and desensitization, A. Sensitizing Dyes, cited above. Typically spectral sensitizing dyes are adsorbed to the surfaces of the grains after chemical sensitization, but advantages for dye addition to high bromide {111} tabular grains prior to or during chemical sensitization have long been recognized, as illustrated by Kofron et al U.S. Pat. No. 4,439,520. The FED sensitizer can be added to the emulsion prior to, during or following spectral sensitization.

The FED sensitizer can be incorporated in the emulsion by the conventional techniques for dispersing spectral sensitizing dyes. That is, the FED sensitizer can be added directly to the emulsion or added after being dissolved in a solvent, such as water, methanol or ethanol, or a mixture of solvents (e.g., an aqueous alcoholic solution). The FED sensitizers may also be added from solutions containing base and/or surfactants. The FED sensitizers may also be incorporated in aqueous slurries or peptizer dispersions.

FED sensitizers are added to the emulsions of the invention to allow intimate contact with the high bromide {111} tabular grains. In preferred forms the FED sensitizers are adsorbed to the grain surfaces. FED sensitizer concentrations in the emulsions of the invention can range from as low as $1\times10^{-8}$ mole per silver mole up to 0.1 mole per silver mole. A preferred concentration range is about $5\times10^{-7}$ to 0.05 mole per silver mole. It is appreciated that the more active forms of the FED sensitizer (e.g., those capable of injecting a higher number of electrons per molecule) can be employed in lower concentrations while achieving the same advantageous effects as less active forms. Although it is preferred that the FED sensitizer be added to the emulsion of the invention before, during or immediately following the addition of other conventional incorporated sensitizers, increases in emulsion sensitivity have been observed even when FED sensitizer addition has been delayed until after the emulsion has been coated.

In addition to high bromide {111} tabular grains, cationic starch peptizer, and FED sensitizer, usually in combination with conventional chemical and/or spectral sensitizers, the emulsions of the invention additionally preferably include one or more conventional antifoggants and stabilizers. A summary of conventional antifoggants and stabilizers is contained in *Research Disclosure*, Item 38957, VII. Antifoggants and stabilizers.

One-equivalent image dye-forming couplers are also particularly useful with the invention. As herein employed, the term "coupler" is employed in its art recognized sense of denoting a compound that reacts with a quinoneduimine derived from an oxidized p-phenylenediamine color developing agent during photographic element development to perform a photographically useful function. A one equivalent image dye-forming coupler can be viewed as a two or four equivalent image dye-forming coupler modified to contain a leaving group that (a) provides the activation for coupling of leaving groups found in two equivalent image dye-forming couplers and (b) contains a dye chromophore capable of contributing to dye image density. In other words, one equivalent image dye-forming couplers can be viewed as being made up of conventional coupling moieties (COUP) of the type found in image dye-forming couplers generally and leaving moieties (LG) that are specifically selected to impart one equivalent coupling.

The image dye-forming couplers are summarized in *Research Disclosure*, Item 38957, X. Dye image formers and modifiers, B. Image-dye-forming couplers contain coupling moieties COUP of the type found in the one equivalent image dye-forming couplers contemplated for use in the image dye forming layer units of the photographic elements of this invention. Although many varied forms of COUP moieties are known, most COUP moieties have been synthesized to facilitate formation of image dyes having their main absorption in the red, green, or blue region of the visible spectrum.

For example, couplers which form cyan dyes upon reaction with oxidized color developing agents are described in such representative patents and publications as: U.S. Pat. Nos. 2,772,162; 2,895,826; 3,002,836; 3,034,892; 2,474,293; 2,423,730; 2,367,531; 3,041,236; 4,333,999; and "Farbkuppler: Eine Literaturubersicht," published in Agfa Mitteilungen, Band III, pp. 156–175 (1961). In the coupler moiety COUP structures shown below, the unsatisfied bond indicates the coupling position to which the leaving moiety LG is attached.

Preferably such cyan dye-forming couplers are phenols and naphthols which form cyan dyes on reaction with oxidized color developing agent at the coupling position, i.e. the carbon atom in the 4-position of the phenol or naphthol. Preferred COUP moieties of the type found in cyan dye-forming couplers are:

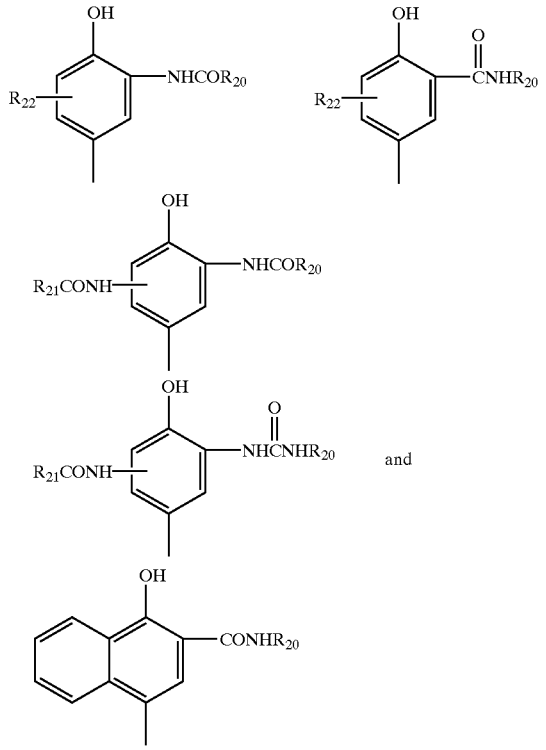

wherein $R^{20}$ and $R^{21}$ can represent a ballast group or a substituted or unsubstituted alkyl or aryl group, and $R^{22}$ represents one or more halogen (e.g., chloro, fluoro), alkyl having from 1 to 4 carbon atoms or alkoxy having from 1 to 4 carbon atoms.

Couplers which form magenta dyes upon reaction with oxidized color developing agent are described in such representative patents and publications as: U.S. Pat. Nos. 2,600,788; 2,369,489; 2,343,703; 2,311,082; 3,824,250; 3,615,502; 4,076,533; 3,152,896; 3,519,429; 3,062,653; 2,908,573; 4,540,654; and "Farbkuppler: Eine Literaturubersicht," published in Agfa Mitteilungen, Band III, pp. 126–156 (1961).

Preferably such magenta dye-forming couplers are pyrazolones and pyrazolotriazoles which form magenta dyes upon reaction with oxidized color developing agents at the coupling position—i.e., the carbon atom in the 4-position for pyrazolones and the 7-position for pyrazolotriazoles. Preferred COUP moieties of the type found in magenta dye-forming couplers are:

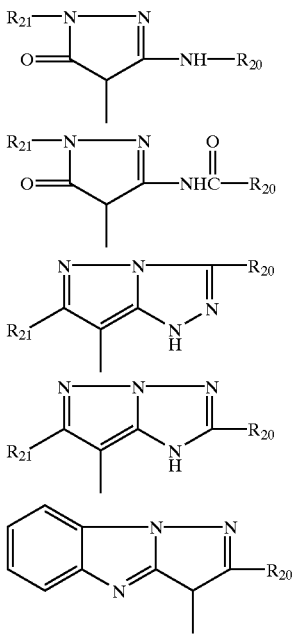

and wherein $R^{20}$ and $R^{21}$ are as defined above. $R^{21}$ for pyrazolone structures is typically phenyl or substituted phenyl, such as, for example, 2,4,6-trihalophenyl, and for the pyrazolotriazole structures $R^{21}$ is typically alkyl or aryl.

Couplers which form yellow dyes upon reaction with oxidized color developing agent are described in such representative patents and publications as: U.S. Pat. Nos. 2,875,057; 2,407,210; 3,265,506; 2,298,443; 3,048,194; 3,447,928; and "Farbkuppler: Eine Literaturubersicht," published in Agfa Mitteilungen, Band III, pp. 112–126 (1961).

Preferably such yellow dye-forming couplers are acylacetamnides, such as benzoylacetanilides and pivalylacetanilides. These couplers react with oxidized developer at the coupling position—i.e., the active methylene carbon atom. Preferred COUP moieties of the type found in yellow dye-forming couplers are:

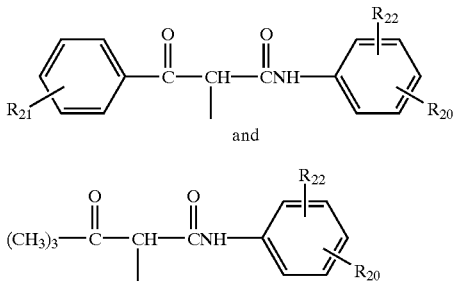

and wherein $R^{20}$ and $R^{21}$ are as defined above and can also be hydrogen, alkoxy, alkoxycarbonyl, alkanesulfonyl, arenesulfonyl, aryloxycarbonyl, carbonamido, carbamoyl, sulfonamido, or sulfamoyl, and $R^{22}$ is hydrogen or one or more halogen, lower alkyl (e.g. methyl, ethyl), lower alkoxy (e.g., methoxy, ethoxy), or a ballast (e.g. alkoxy of 16 to 20 carbon atoms) group.

Other preferred COUP moieties of the type found in yellow dye-forming couplers are of the formula:

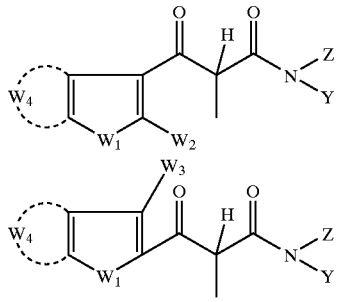

or wherein:

$W_1$ is a heteroatom or heterogroup, preferably —NR—, —O—, —S—, —$SO_2$—;

$W_2$ is H, or a substituent group, such as an alkyl or aryl group;

$W_3$ is H, or a substituent group, such as an alkyl or aryl group;

$W_4$ represents the atoms necessary to form a fused ring with the ring containing $W_1$, preferably a benzo group, Y and Z are independently H or a substituent group, preferably Y is H and Z is a substituted phenyl group.

Other preferred COUP moieties of the type found in yellow dye-forming couplers are of the formula:

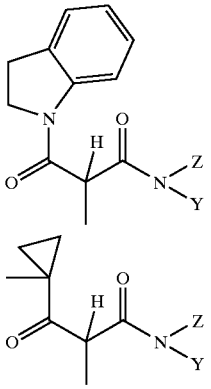

or wherein Y and Z are as defined above.

The leaving group LG differs from the leaving groups of two equivalent image dye-forming couplers in that LG itself contains a dye chromophore. If the dye chromophore of LG exhibits the same hue before and after separation from COUP, it does not contribute to forming a dye image, but simply increases dye density uniformly in all image areas. To obtain a desired image dye light absorption when LG is released from COUP while avoiding unwanted light absorption by the dye chromophore in LG when LG remains attached to COUP, conventional LG constructions are chosen to produce a bathochromic shift of light absorption in released LG as compared to COUP attached LG. For example, assuming that a yellow (blue light absorbing) dye image is sought, LG can be constructed to contain an ultraviolet absorbing dye chromophore when attached to COUP, and release from COUP can result in shifting absorption bathochromically into the blue region of the spectrum, thereby changing the perceived hue of the LG incorporated dye from essentially colorless to yellow. With LG constructions permitting longer wavelength bathochromic shifts, the LG hue can shift from essentially colorless (UV absorbing) to green or even red. For green and red absorbing dyes in released LG, it is recognized that initial (COUP attached)

LG absorption may, depending upon the construction chosen, extend into the visible region of the spectrum. This initially visible absorption is lost when LG is released. The loss of light absorption in a selected region of the visible spectrum as a result of a coupling reaction is a property also exhibited by conventional masking couplers, commonly used in color negative films for color correction. Thus, it is possible to choose the initial absorption of LG as attached to COUP so that the absorption shift on release performs the function of a masking coupler.

LG can take the form of any conventional one equivalent coupler leaving group. One equivalent couplers having leaving groups suitable for use in the image forming layer units of the photographic elements of the invention are described in Lau U.S. Pat. No. 4,248,962 and Mooberry et al U.S. Pat. Nos. 4,840,884; 5,447,819; and 5,457,004. The one equivalent image dye-forming couplers of Mooberry et al are preferred, since they do not require mordanting on release to retain their desired hue. Viewed another way, the Mooberry et al one equivalent image dye-forming couplers can contain release dyes that are charge neutral.

Preferred one equivalent image dye-forming couplers include the following components:

$$\text{COUP-L}'_n\text{—B'—N(R}_{23}\text{)-DYE}$$

wherein:

COUP is the coupler moiety;

DYE is an image dye or image dye precursor;

$L'_n$—B' is a group that is at least divalent;

B' is —OC(O)—, —OC(S)—, —SC(O)—, —SC(S)— or —OC(=$NSO_2R_{24}$)—, where $R_{24}$ is a substituted or unsubstituted alkyl or aryl group;

L' is a linking group;

$R_{23}$ is a substituent; and n is zero or 1.

The COUP bond and the B'—N($R_{23}$) bond are both cleaved under conditions permitting coupling off to occur. Cleaving the B'—N($R_{23}$) bond bathochromically shifts the hue of the DYE.

DYE can include an auxochrome associated with the dye, where an auxochrome is a group that increases dye absorption intensity.

B' in the form of —OC(=$NSO_2R_{24}$)— and —OC(O)—, particularly the latter, is preferred to maintain the lowest possible densities in unexposed areas.

N($R_{23}$) either forms a part of the auxochrome or chromophore of DYE. Illustrative groups in which —N($R_{23}$)— forms a pail of an auxochrome are as follows:

The nitrogen atom in —$NR_{23}$— is optionally located in an auxochrome, that is a group that intensifies the color of the dye, or it is optionally an integral part of the dye chromophore.

Illustrative groups wherein —$NR_{23}$— is part of auxochrome are as follows:

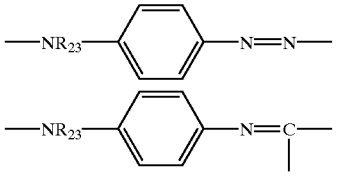

-continued

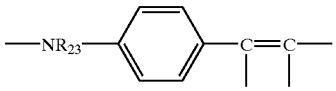

Illustrative groups in which —N($R_{23}$)— forms a part of a dye chromophore are as follows:

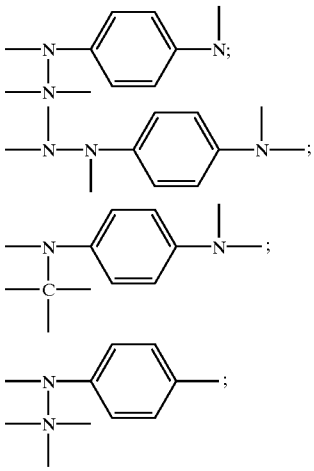

The particular group $L'_n$—B' can be varied to help control such parameters as rate and time of release of the —$NR_{23}$—DYE group. The particular group $L'_n$—B' employed, including the nature of the substituents on $L'_n$—B', can additionally control the rate and distance of diffusion of the unit formed by the group $L'_n$—B', the —$NR_{23}$— group and the DYE after this unit is released from the coupler moiety but before the —$NR_{23}$— DYE is released. The group $L'_n$—B' preferably causes a spectral shift in absorption of DYE as a function of attachment to —$NR_{23}$—. Also, the group $L'_n$—B' preferably stabilizes the DYE to oxidation, particularly wherein the —$NR_{23}$— is part of the chromophore.

The coupler moiety COUP can be any moiety which will react with oxidized color developing agent to cleave the bond between the $L'_n$—B' group and the coupler moiety. It includes coupler moieties employed in conventional color-forming couplers which yield colorless products on reaction with oxidized color developing agents, as well as coupler moieties which yield colored products on reaction with oxidized color developing agents. Both types of coupler moieties are well known to those skilled in the art.

The coupler moiety can be unballasted or ballasted with an oil-soluble or fat-tail group. It can be monomeric, or it can form part of a dimeric, oligomeric or polymeric coupler, in which case more than one —$L'_n$—B'—$NR_{23}$-DYE unit can be contained in the coupler.

It will be appreciated that, depending upon the particular coupler moiety, the particular color developing agent and the type of processing, the reaction product of the coupler moiety and oxidized color developing agent can be: (1) colored and nondiffusible, in which case it will remain in the location where it is formed; (2) colored and diffusible, in which case it may be removed during processing from the location where it is formed or allowed to migrate to a different location; or (3) colorless.

The —$L'_n$—B'—$NR_{23}$-DYE unit is joined to the coupler moiety at any of the positions from which groups released from couplers by reaction with oxidized color developing agent can be attached. The —$L'_n$—B'—$NR_{23}$-DYE unit is attached at the coupling position of the coupler moiety so that upon reaction of the coupler with oxidized color developing agent the —$L'_n$—B'—$NR_{23}$-DYE will be displaced.

The group $L'_n$—B' can be any organic group which will serve to connect COUP to the —$NR_{23}$— group and which, after cleavage from COUP will cleave from the —$NR_{23}$— group, for example, by an elimination reaction of the type described in, for example, U.S. Pat. No. 4,409,323. The elimination reaction involves electron transfer down a conjugated chain. As used herein the term "electron transfer down a conjugated chain " is understood to refer to transfer of an electron along a chain of atoms in which alternate single bonds and double bonds occur. A conjugated chain is understood to have the same meaning as commonly used in organic chemistry. Electron transfer down a conjugated chain is as described in, for example, U.S. Pat. No. 4,409,323.

The group $L'_n$—B' can contain moieties and substituents which will permit control of one or more of the following rates: (i) the rate of reaction of COUP with oxidized color developing agent, (ii) the rate of diffusion of —$L'_n$—B'—$NR_{23}$-DYE and (iii) the rate of release of DYE. The group $L'_n$—B' can contain additional substituents or precursors thereof which may remain attached to the group or be released.

Illustrative $L'_n$—B' groups include:

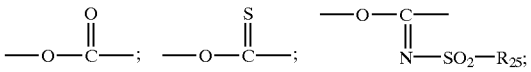

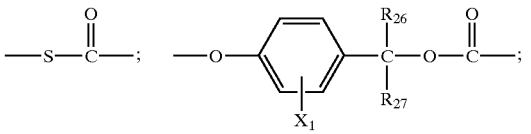

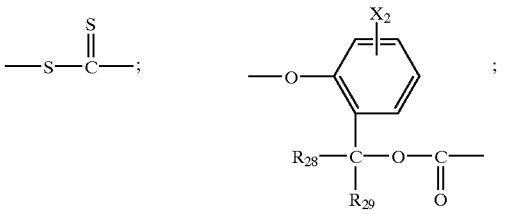

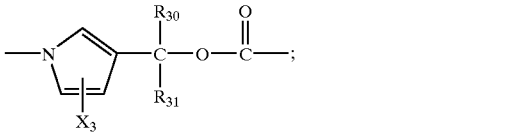

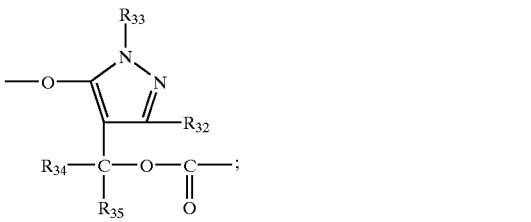

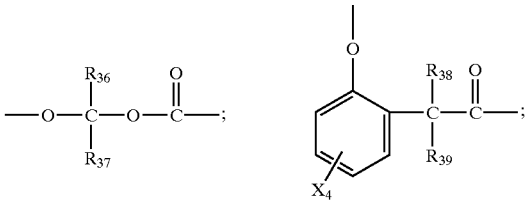

-continued

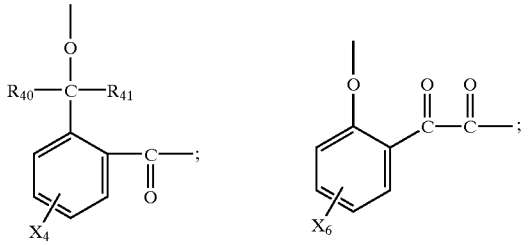

wherein $X_1$ through $X_6$ and $R_{23}$ through $R_{41}$ are substituents that do not adversely affect the described COUP-$L'_n$—B'—$NR_{23}$-DYE. For example, $R_{23}$ through $R_{41}$ are individually hydrogen, unsubstituted or substituted alkyl, such as alkyl containing 1 to 30 carbon atoms, for example, methyl, ethyl, propyl, n-butyl, t-butyl, pentyl and eicosyl; or cycloalkyl, such as cyclopentyl, cyclohexyl and 4-methoxycyclohexyl; or aryl, such as unsubstituted or substituted phenyl. $X_1$ through $X_6$ can be hydrogen or a substituent that does not adversely affect the described COUP-$L'_n$—B'—$NR_{23}$-DYE, such as electron withdrawing or donating groups, for example, alkyl, such as methyl, ethyl, propyl, n-butyl, t-butyl and eicosyl, halogen, such as chlorine and bromine, nitro, carbamyl, acylamido, sulfonamido, sulfamyl, sulfo, carboxyl, cyano, and alkoxy, such as methoxy and ethoxy, acyl, sulfonyl, hydroxy, alkoxycarbonyl, and aryloxy. The group $L'_n$—B' can be, for example, a linking group within U.S. Pat. No. 4,409,323 or a nucleophilic displacement type linking group as described in, for example, U.S. Pat. No. 4,248,962, or a linking group which is a combination of these two types.

A particularly useful $L'_n$—B' group is:

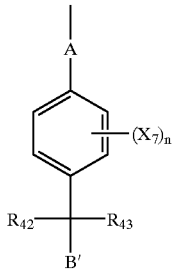

wherein

A is O, S, or sulfonamido (N—$SO_2$ $R_{44}$);

B' is as previously defined;

$R_{42}$ and $R_{43}$ are individually hydrogen, or substituted or unsubstituted alkyl, such as methyl, ethyl, propyl, n-butyl or t-butyl, or aryl, such as unsubstituted or substituted phenyl; $X_7$ is a substituent as described for $X_1$, that does not adversely affect the coupler; and n is 0, 1, 2, 3 or 4. $R_{44}$ is a substituent, typically alkyl or aryl. Typically $R_{42}$ and $R_{43}$ are hydrogen.

Typically $R_{42}$ and $R_{43}$ are hydrogen.

Preferred $L'_n$—B' linking groups include:

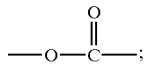

and

-continued

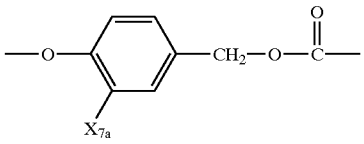

wherein $X_{7a}$ is hydrogen, chlorine, methylsulfonamido ($NHSO_2CH_3$), —$COOCH_3$, —$NHCOCH_3$, —$CONHCH_3$, —$COHNCH_2COOH$, —COOH or $CON(CH_3)_2$.

A particularly useful linking group is represented by the formula:

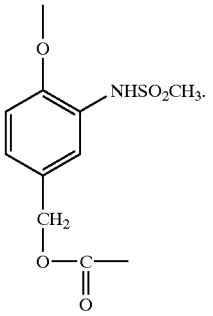

The linking group and DYE optionally contain substituents that can modify the rate of reaction, diffusion, or displacement, such as halogen, including fluoro, chloro, bromo, or iodo, nitro, alkyl of 1 to 20 carbon atoms, acyl, carboxy, carboxyalkyl, alkoxycarbonyl, alkoxycarbonamido, alkylcarbamyl, sulfoalkyl, alkylsulfonamido, and alkylsulfonyl, solubilizing groups, ballast groups and the like. For example, solubilizing groups will increase the rate of diffusion and ballast groups will decrease the rate of diffusion.

The $R_{23}$ substituent on —$NR_{23}$— can be any substituent that does not adversely affect the coupler (A). When the —$NR_{23}$— is part of an auxochrome, $R_{23}$ can be, for example, hydrogen or alkyl, such as alkyl containing 1 to 30 carbon atoms, including methyl, ethyl, propyl, n-butyl, t-butyl or eicosyl, or aryl, such as phenyl. When the nitrogen atom attached to $L'_n$—B' is part of a chromophore, $R_{23}$ becomes an integral part of the chromophore.

Preferred $R_{23}$ groups are alkyl, such as alkyl containing 1 to 18 carbon atoms when $R_{23}$ is part of the dye auxochrome. $R_{23}$ when part of the chromophore is, for example, unsubstituted or substituted aryl, such as phenyl.

The DYE as described includes any releasable, electrically neutral dye that enables dye hue stabilization without mordanting the dye formed. The release mechanism can be initiated by oxidized reducing agent.

The particular DYE and the nature of the substituents on the DYE can control whether or not the dye diffuses and the rate and distance of diffusion of the DYE formed. For example, the DYE can contain a ballast group known in the photographic art that hinders or prevents diffusion. The DYE can contain a water solubilizing group, such as carboxy or sulfonamide groups, to help diffusion of the DYE. Such groups are known to those skilled in the art.

Particularly useful classes of DYE moieties are:

I. Azo dye moieties including the —$NR_{23}$— group represented by the structure:

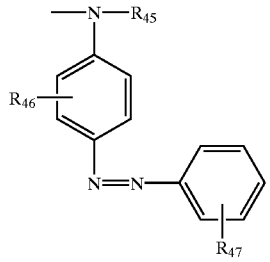

wherein $R_{45}$, $R_{46}$ and $R_{47}$ are individually hydrogen or a substituent, such as alkyl. The aromatic rings containing $R_{46}$ and $R_{47}$ may also be heteroaromatic rings containing one or more ring N atoms.

II. Azamethine dye moieties including the —$NR_{23}$— group represented by the structure:

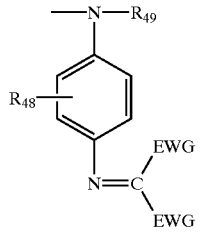

wherein $R_{48}$ is hydrogen or a substituent, such as alkyl; $R_{49}$ is hydrogen or a substituent, such as alkyl; and EWG is an electron withdrawing group.

III. Methine dye moieties including the —$NR_{23}$— group represented by the structure:

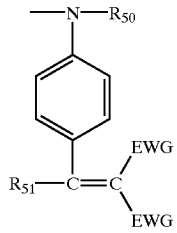

wherein $R_{50}$ is hydrogen or a substituent, such as alkyl; $R_{51}$ is hydrogen or a substituent such as alkyl, and EWG is an electron withdrawing group.

The term DYE also includes dye precursors wherein the described substituted nitrogen atom is an integral part of the chromophore, also described herein as leuco dye moieties. Such dye precursors include, for example:

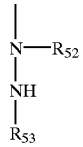

wherein $R_{52}$ and $R_{53}$ are aryl, such as substituted phenyl;

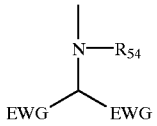

wherein $R_{54}$ is an aryl group, such as substituted phenyl; and EWG is an electron withdrawing group;

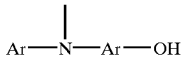

wherein Ar are individually substituted aryl groups, particularly substituted phenyl groups. When the DYE moiety is a leuco dye, $L'_n$—B' preferably comprises a timing group that enables delay of oxidation of the leuco dye by silver halide in a photographic silver halide element. For example, it is preferred that $L'_n$—B' be a

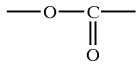

group when DYE is a leuco dye moiety as described.

Examples of cyan, magenta, yellow and leuco dyes are as follows:

A. Cyan

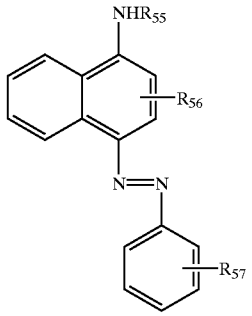

wherein $R_{55}$ is a substituent that does not adversely affect the dye, such as alkyl; $R_{56}$ is a substituent, such as an electron releasing group; and $R_{57}$ is a substituent, such as a strong electron withdrawing group.

B. Magenta

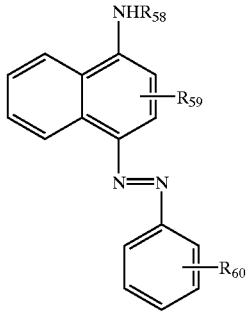

wherein $R_{58}$ is a substituent that does not adversely affect the dye, such as alkyl; $R_{59}$ is a substituent, such as an electron releasing group; and $R_{60}$ is a substituent, such as a strong electron withdrawing group.

C. Yellow

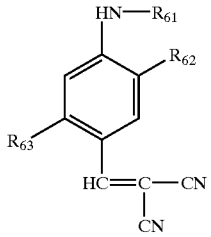

wherein $R_{61}$ is alkyl; $R_{62}$ is alkoxy; and $R_{63}$ is alkyl; and

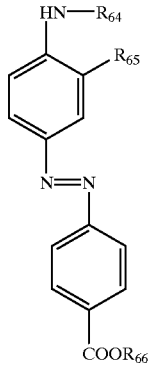

wherein $R_{64}$ is alkyl; $R_{65}$ is alkoxy; and $R_{66}$ is alkyl or aryl.

D. Leuco

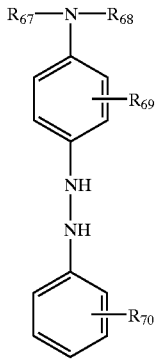

wherein $R_{67}$ and $R_{68}$ are individually hydrogen or alkyl; $R_{69}$ is an electron releasing group; and $R_{70}$ is a strong electron withdrawing group.

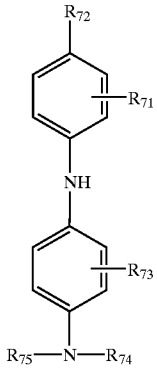

wherein $R_{71}$ and $R_{73}$ are individually hydrogen or a substituent; $R_{72}$ is a hydroxyl, $NHR_{76}$ or NHSO2 $R_{76}$ wherein $R_{76}$ is a substituent; $R_{74}$ and $R_{75}$ are individually hydrogen or a substituent.

The following are specific illustrations of one equivalent image dye-forming couplers contemplated for use in the practice of this invention:

OEC-1

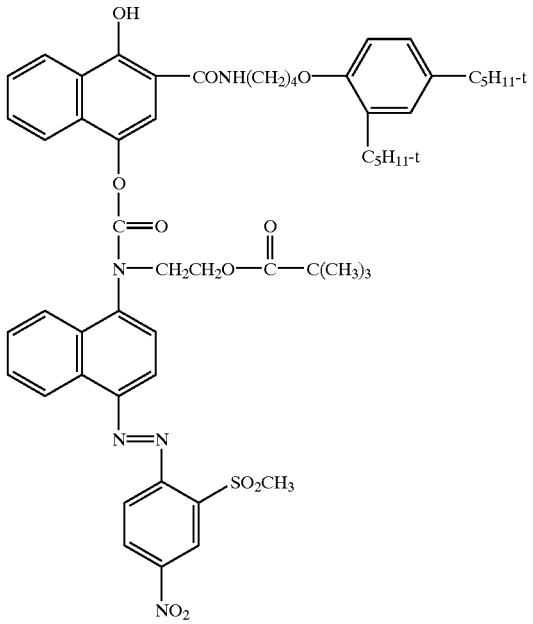

OEC-2

$X^a$ = $NHCHOCH_3$

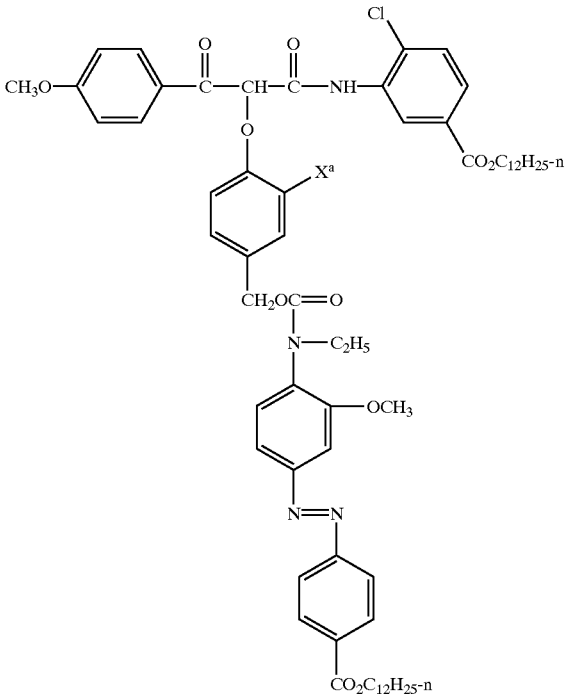

OEC-3

$X^a$ = $NHSO_2CH_3$

-continued
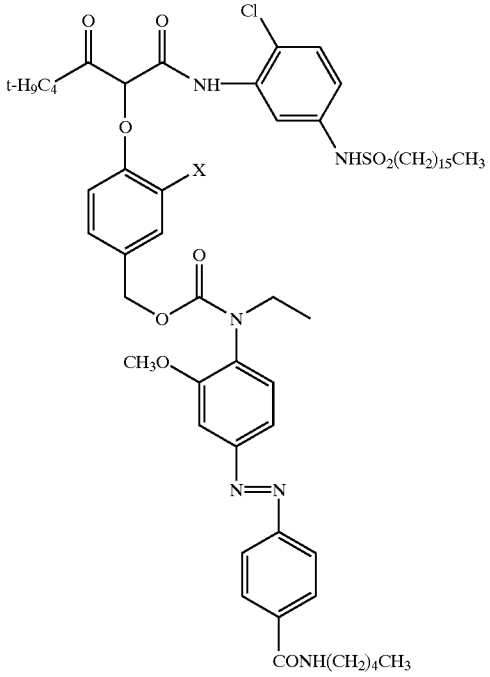
OEC-4
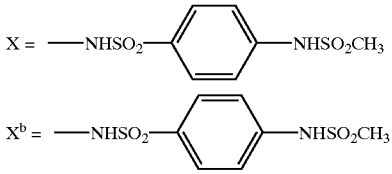
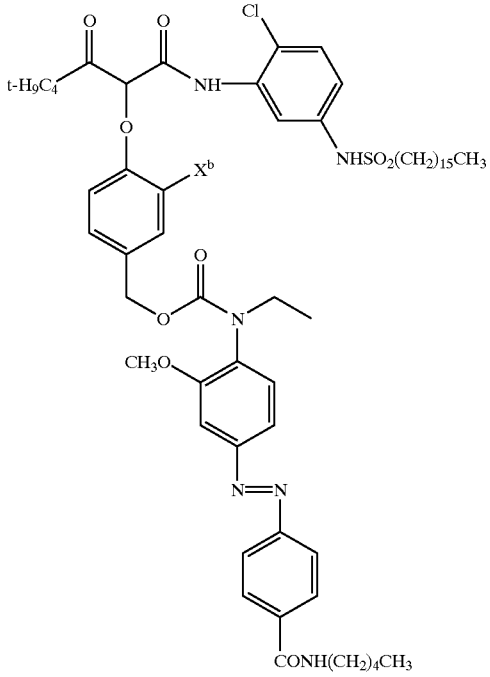
OEC-5
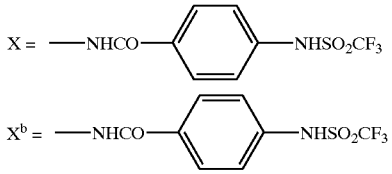
OEC-6
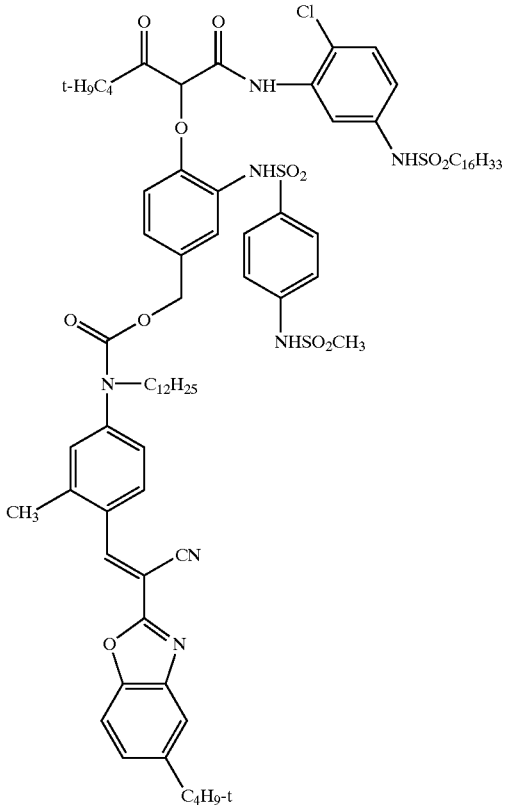

-continued
OEC-7
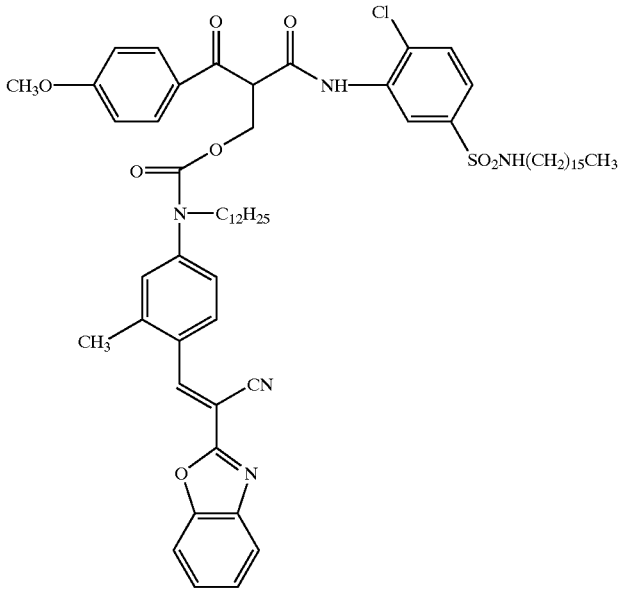
OEC-8
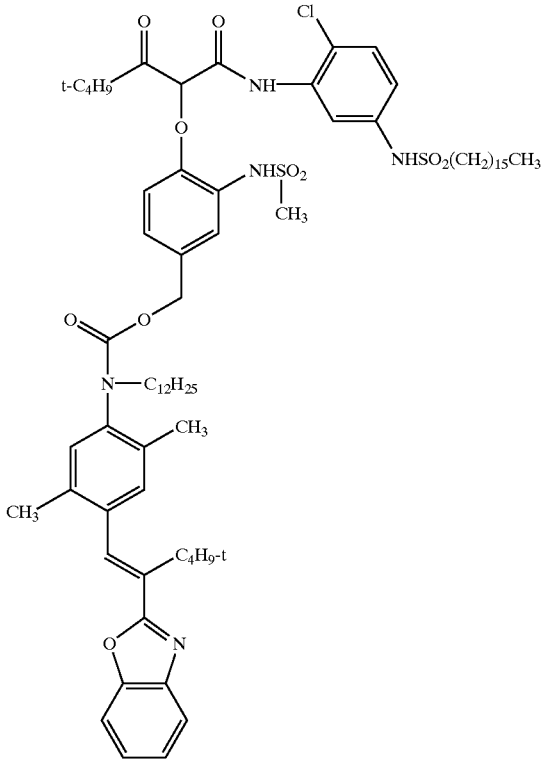
OEC-9
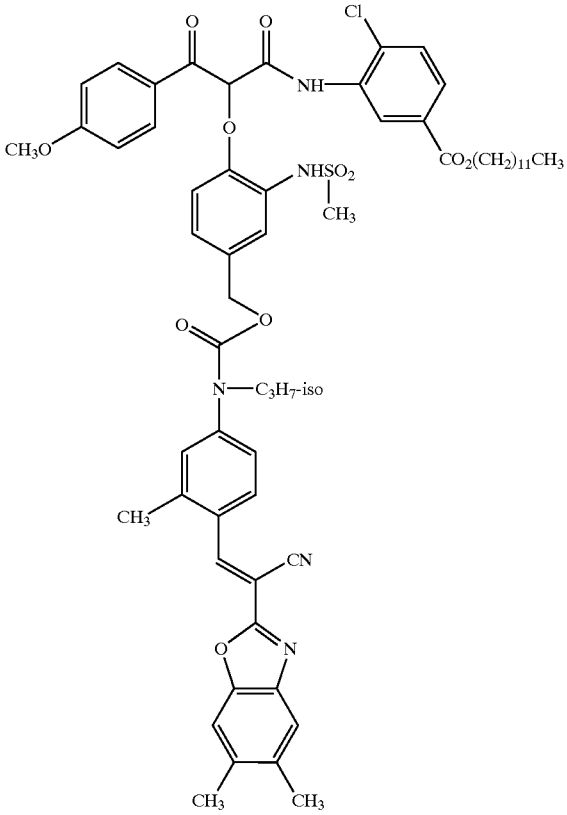

-continued
OEC-10
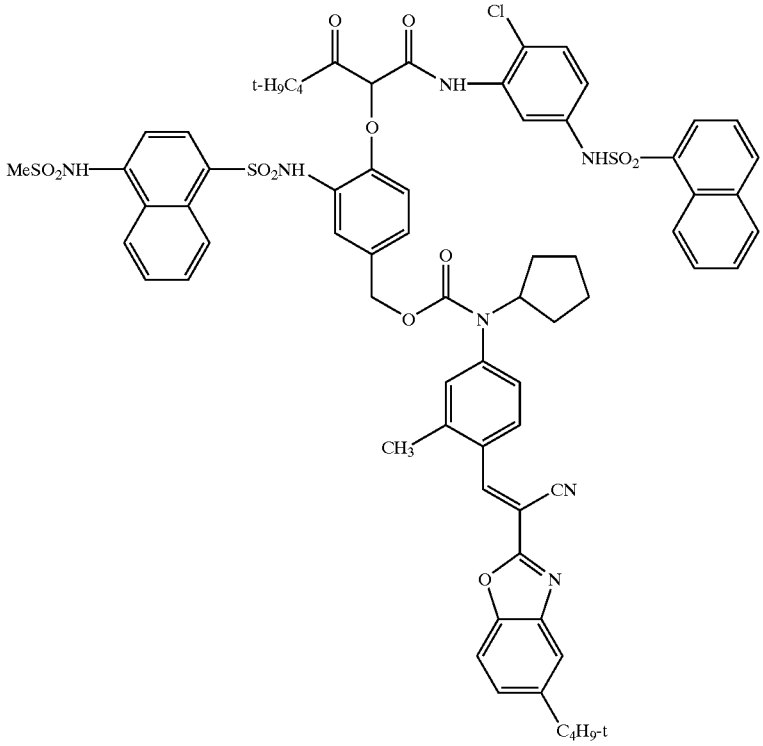
OEC-11
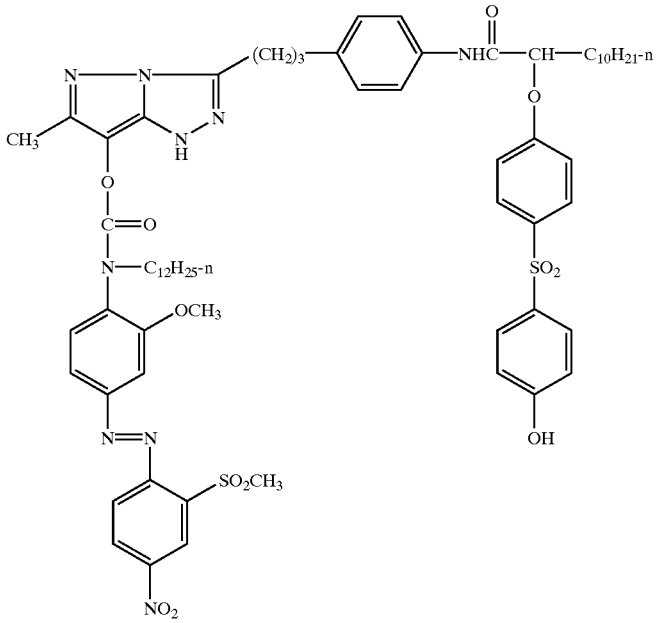

-continued

OEC-12

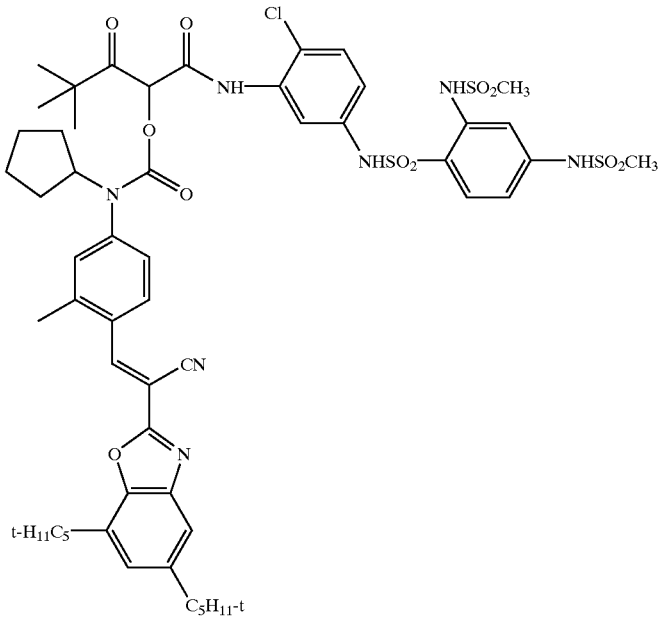

In addition to one equivalent image dye-forming coupler, the image forming layer unit can, if desired, contain one or more other conventional couplers. For example, it is contemplated to employ one or more four equivalent or, particularly, two equivalent image dye-forming couplers in combination with an image dye-forming one equivalent coupler. When image dye-forming couplers are used in combination, it is preferred that at least 20 percent on a mole basis of image dye-forming coupler present be provided by one or more one equivalent image dye-forming couplers.

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight- or branched-chain or cyclic alkyl, such as methyl, trifluoromethyl, ethyl, t-butyl, 3-(2,4-di-t-pentylphenoxy) propyl, and tetradecyl, alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy, aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramindo, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl, carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, bexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy- 5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine, imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided.

The photographic elements of the invention are multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various-orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire PO10 7DQ, ENGLAND, and as described in Hatsumi Kyoukai Koukai Gihou No. 94-6023, published March 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the discussion of suitable materials for use in the emulsions and elements of this invention, reference will be made to *Research Disclosure*, September 1996, Item 38957, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

The silver halide elements of the invention are generally negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. Certain desirable photographic elements and processing steps are described in *Research Disclosure*, Item 37038, February 1995.

The element may contain image dye forming couplers in addition or in place of the one-equivalent couplers described above. As discussed above, coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. 2-equivalent couplers are particularly useful with this invention. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169; 3,227,551; 3,432,521; 3,476,563; 3,617,291; 3,880,661; 4,052,212; and 4,134,766; and in U.K. Patents and published application Nos. 1,466,728; 1,531,927; 1,533,039; 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,333,999; 4,883,746; and "Farbkuppler-eine LiteratureLUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082; 2,343,703; 2,369,489; 2,600,788; 2,908,573; 3,062,653; 3,152,896; 3,519,429; 3,758,309; 4,540,654; and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos.

2,298,443; 2,407,210; 2,875,057; 3,048,194; 3,265,506; 3,447,928; 4,022,620; 4,443,536; and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as U.K. Patent No. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-arninophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628; 5,151,343; and 5,234,800.

It may be useful to use a combination of couplers any of which may contain known ballasts or coupling-off groups such as those described in U.S. Pat. Nos. 4,301,235; 4,853,319; and 4,351,897. The coupler may contain solubilizing groups such as described in U.S. Pat. No. 4,482,629. The coupler may also be used in association with "wrong" colored couplers (e.g., to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0, although dispersions using no permanent coupler solvent are sometimes employed.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g., as described in U.S. Pat. Nos. 4,366,237; 4,420,556; and 4,543,323; and EP 96,570). Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336; as well as in patent publications GB 1,560,240; GB 2,007,662; GB 2,032,914; GB 2,099,167; DE 2,842,063, DE 2,937,127; DE 3,636,824; DE 3,644,416, as well as the following European Patent Publications: 272,573; 335,319; 336,411; 346, 899; 362, 870; 365,252; 365,346; 373,382; 376,212; 377,463; 378,236; 384,670; 396,486; 401,612, 401,613.

Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

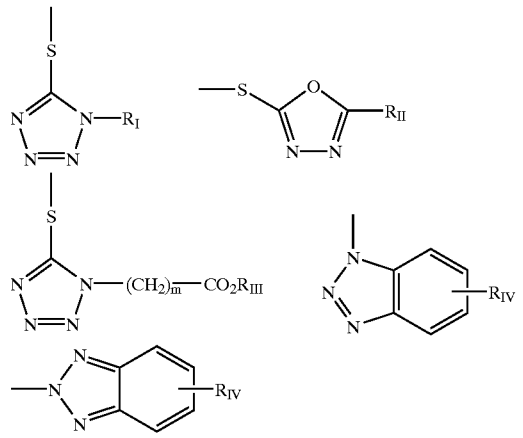

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

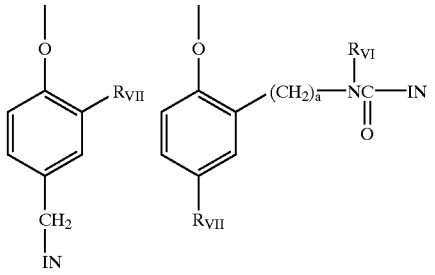

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, and Japanese Kokai 60-249148 and 60-249149.

Suitable developer inhibitor-releasing couplers for use in the present invention include, but are not limited to, the following:

D1

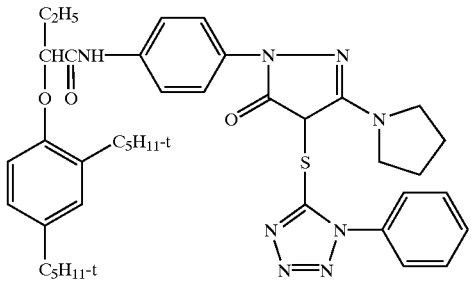

-continued

D2

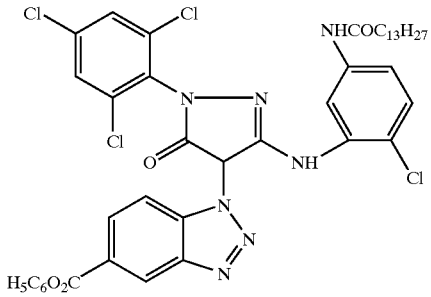

D3

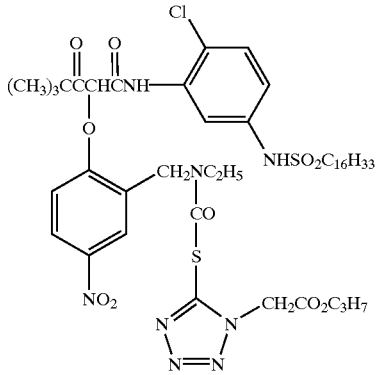

D4

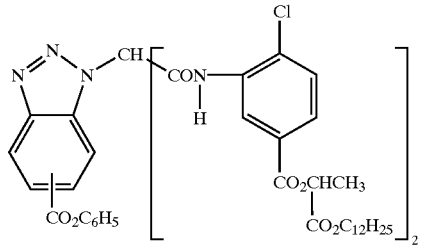

D5

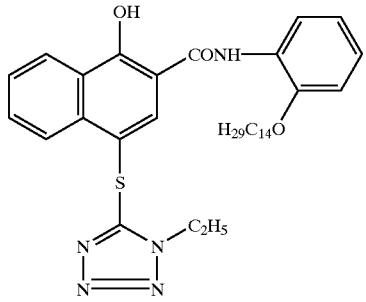

-continued

D6

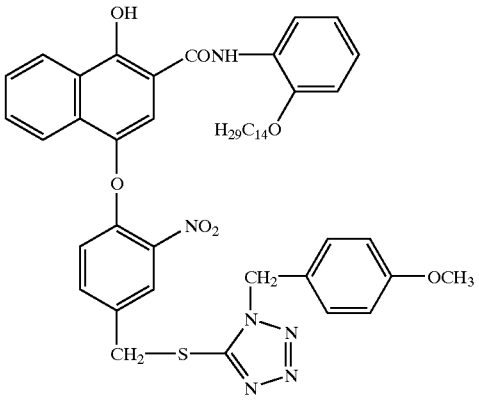

D7

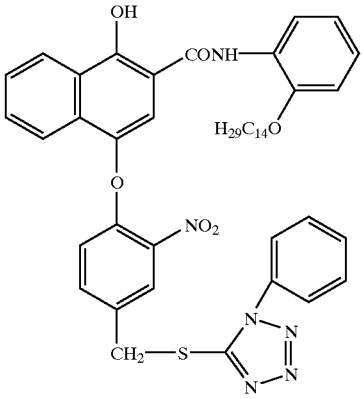

D8

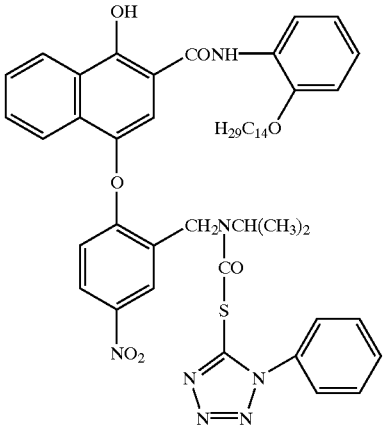

D9

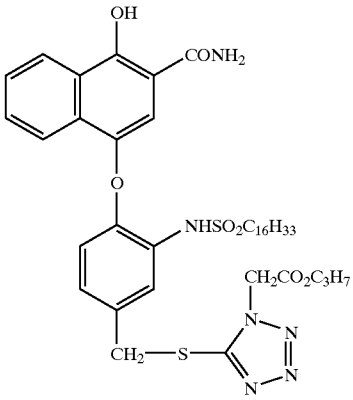

-continued

D10

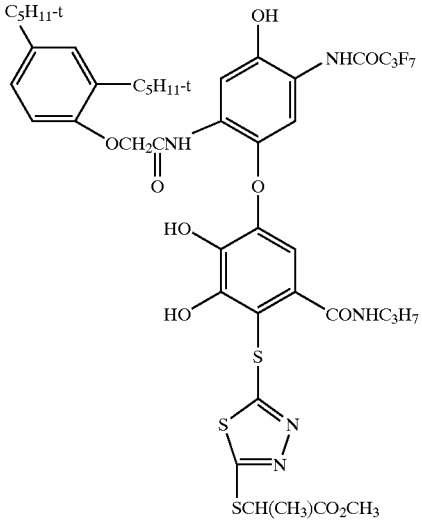

D11

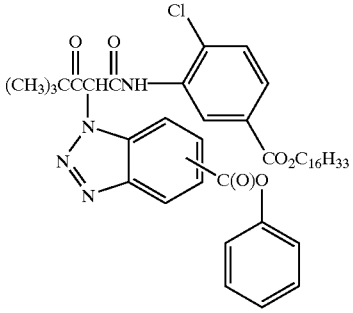

D12

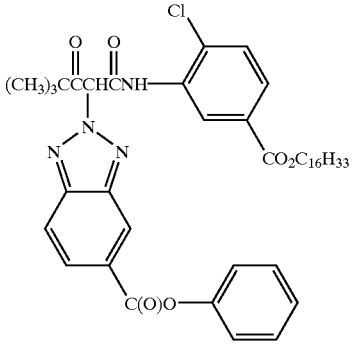

Photographic elements can be exposed to actinic radiation, typically in the visible region of the spectnim, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative Image. One type of such element, referred to as a color negative film, is designed for image capture. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3'15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Another type of color negative element is a color print. Such an element is designed to receive an image optically printed from an image capture color negative element. A color print element may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold packaged with instructions to process using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patents and other publications cited in this specification are incorporated herein by reference.

The following examples illustrate the practice of this invention. They are not intended to be exhaustive of all possible variations of the invention. Parts and percentages are by weight unless otherwise indicated.

EXAMPLES

Preparation of Inventive Antifoggant A-1

Antifoggant A-1 is 2,2'-dibromo-(4-methylphenyl) sulfonyl-N-(2-sulfoethyl)acetamide potassium salt, and has the structure shown above. Compound A-1 was prepared as follows:

To a 5-liter flask equipped with a mechanical stirrer and reflux condenser was added p-toluenesulfinic acid, lithium salt (308.57 g), N-(2-sulfoethyl)-2-bromoacetamide, lithium salt (527.39 g), water (180 ml), and ethyl alcohol (3380 ml). The resulting suspension was heated to reflux. After about an hour of reflux, nearly all of the reactants had dissolved. Reflux was continued another four hours, and the solution was filtered hot through a Celite pad to remove some haziness. The solution was cooled overnight to room temperature. The solid that formed was collected and washed with 1 liter of 95% ethyl alcohol/water. The white solid was air dried and then dried at high vacuum, providing 553.88 g (89% yield) of 2-(4-methylphenyl)sulfonyl-N-(2-sulfoethyl) acetamide, lithium salt (Intermediate 1). HPLC analysis showed no detectable impurities. Ion chromatography indicated 0.035 weight % bromide and 1.8 weight % lithium. The material exhibited an acceptable proton spectrum.

To glacial acetic acid (660 ml) was added Intermiediate 1 (98.19 g), and 1,3-dibromo-5,5-dimethylhydantoin (42.89 g). The resulting suspension was heated to reflux where solution occurred. After about 3–5 minutes at reflux, the slight bromine color was discharged, and reflux was continued to another 15 minutes. Analysis of the reaction mixture by HPLC indicated conversion to one main product. After cooling to near room temperature, most of the acetic acid was removed on the rotary film evaporator using a water aspirator (water bath temperature at 40° C.). The residue was diluted with 2500 ml of ethyl alcohol. Complete solution occurred after stirring the suspension for one hour at room temperature. To this stirring solution at room temperature was added dropwise a solution of potassium acetate (58.88 g) dissolved in ethyl alcohol (500 ml). A white solid formed immediately. Upon complete addition of the potassium acetate solution, the suspension was stirred at room temperature for 90 minutes, and the desired anti foggant A-1, 2,2-dibromo-2-(4-methylphenyl)sulfonyl-N-(2-sulfoethyl)acetamide, potassium salt, was collected by filtration and washed with ethyl alcohol. The solid was then dried under high vacuum at 40° C. The yield of crude antifoggant A-1, which had a slight odor of acetic acid, was 145.22 g (94%).

Two separate synthetic batches of A-1 were made, combined, and recrystallized by dissolving 182.33 g of product in a mixture of water (85 ml) and ethyl alcohol (600 ml) while boiled, filtered hot, and adding about 7 ml water upon cooling to prevent oiling. After letting the solution stand overnight at room temperature, the desired anti foggant product was collected and washed with about 300 ml (10:1 v/v) ethyl alcohol/water mixture. The product was then air-dried and then dried under high vacuum at 40° C., providing 159.87 g of desired product. HPLC analysis indicated an assay of 99.2% of the desired component. The product exhibited the expected proton nmr spectrum and mass spectrum consistent with the A-1 structure shown above.

Preparation of Inventive Antifoggant A-2

Inventive antifoggant A-2 is 2,2'-dibromo-(4-methylphenyl)sulfonyl-N-(2-carboxyethyl)acetamide, potassium salt, and has the structure noted above. Compound A-2 was prepared similarly to Compound A-1 except that the N-(2-sulfoethyl)-2-bromoacetamide, lithium salt is replaced by the HCl salt of the ethyl ester of β-alanine. The resulting substituted bromoacetamide is reacted as above with the sodium salt of toluenesufinic acid followed by alkaline hydrolysis of the ester and subsequent reaction with bromine to form A-2.

Preparation of Inventive Antifoggant A-7

Inventive antifoggant A-7 was prepared similarly to Compound A-1 except that N-bromoacetylmethanesulfonamide was reacted with the sodium salt of toluenesufinic acid, followed by bromination with molecular bromine.

Preparation of Inventive Antifoggant A-20

Inventive antifoggant A-20 is 2-bromo-2-(4-methylphenyl)sulfonyl-N-(2-sulfoethyl)acetamide lithium salt, and has the structure drawn above. Compound A-20 was prepared as follows: To glacial acetic acid (125 ml) was added Intermediate 1 (18.66 g), and the suspension was heated in an oil bath at a temperature of 52° C. To the stirring suspension was added dropwise over a 5 hr period a solution of bromine (14.77 g) dissolved in glacial acetic acid (15 ml). Upon complete addition, the temperature of the oil bath was maintained at 52° C. for 75 min., and then the heat was removed. Upon standing at room temperature, solid formed. The product was collected and washed sequentially with glacial acetic acid and acetonitrile and dried in a vacuum oven, obtaining 20.21 g of a white solid. The material was further purified by dissolving the solid (17.30 g ) at the boil in 200 ml acetonitrile containing 4 ml water, and then cooling to room temperature. Examination by HPLC indicated greater than 99% one component that analyzed by both mass spectroscopy and NMR for A-20, 2-bromo-2-(4-methylphenyl)sulfonyl-N-(2-sulfoethyl)acetamide lithium salt.

Example 1

Preparation of "Low Fogging" Emulsion

An AgBrI tabular silver halide emulsion (Invention) was prepared containing 3.8% total iodide distributed such that the central portion of the emulsion grains contained no iodide and the perimeter area contained substantially higher iodide as described by Fenton et al U.S. Pat. No. 5,476,760. Unlike the emulsions described by Fenton et al, the inventive emulsions described below did not contain the pluronic surfactant, nor does it use gelatin as a peptizer. The iodide architecture and precipitation details are similar to (U.S. application Ser. Nos. 09/731,445 and 09/731,446 of Maskasky, all filed Dec. 7, 2000).

A starch solution was prepared by heating at 85° C. for 45 min a stirred mixture of 5.4 L distilled water and 127 g of an oxidized cationic waxy corn starch. (The starch derivative, STA-LOK® 140 is 100% amylopectin that had been treated to contain quaternary ammonium groups and oxidized with 2 wt % chlorine bleach. It contains 0.31 wt % nitrogen and 0.00 wt % phosphorous. It was obtained from A. E. Staley Manufacturing Co., Decatur, Ill.). After cooling to 40° C., the weight was adjusted to 8.0 kg with distilled water, 21.2 mL of a 2 M NaBr solution was added, then while maintaining the pH at 5.0, 1.6 mL of saturated bromine water (~0.72 mmole) was added dropwise just prior to use.

To a vigorously stirred reaction vessel of the starch solution at 40° C. and maintained at pH 3.0 throughout the emulsion precipitation, a 2.5 M $AgNO_3$ solution was added at 78.2 mL per min for 60 sec. Concurrently, a 2.5 M NaBr salt solution was added initially at 78.2 mL per min and then at a rate needed to maintain a pBr of 1.87. Then the addition of the silver solution was stopped while the salt solution was run until the pBr was brought down to a value of 1.52. The temperature of the contents of the reaction vessel was then increased to 70° C. at a rate of 1.67° C. per min. After holding at 70° C. for 1 min, additional treated starch equal to one-half the initial reactor charge was introduced to the reaction vessel. The pBr was readjusted upwards to 1.82 with the silver nitrate solution. A 15 minute constant flow growth segment (7.6 mL per min) was then initiated at this pBr such that 4.7% of the final emulsion was precipitated. The pBr was then lowered to 1.72 with salt solution and a 66 minute growth segment ensued with salt solution controlling at this pBr and silver solution increasing from 11.4 to 63.4 mL per minute. At the end of this segment, $^{2}/_{3}{}^{rd}$ of the total emulsion had been precipitated.

The silver nitrate solution flow was stopped and a second salt solution containing 0.4 M NaBr and 0.44 M KI was pumped to the reaction vessel over a period of 18 minutes during which time the pBr was lowered to 1.07. A metal hexacyanide dopant, $K_4Fe(CN)_6$, was introduced over a period of 2 min at a concentration of 36 molar parts per million (bulk). The pBr was then raised to a value of 2.75 by flowing only silver nitrate solution. Once this pBr was reached, 80% of the precipitation was complete and a double jet introduction of salts and silver continued for 17 minutes, during which time the remainder of the emulsion was precipitated.

The resulting tabular grain emulsion was washed by ultrafiltration at 40° C. to a pBr of 3.36. Then 27 g of bone gelatin (methionine content ~55 micromole per g gelatin) per mole silver was added.

The {111} tabular grains had an average equivalent circular diameter of 3.43 μm, an average thickness of 0.124 μm, and an average aspect ratio of 28.

Preparation of Comparative Emulsion

An AgBrI tabular silver halide emulsion (Comparative Emulsion) was prepared containing 4.1% total iodide distributed such that the central portion of the emulsion grains contained no iodide and the perimeter area contained substantially higher iodide as described by Chang et. al U.S. Pat. No. 5,314,793. This emulsion had an average equivalent circular diameter of 2.9 μm and an average thickness of 0.13 μm.

Sensitization of Emulsions

The following chemical (amount per mole silver) were added to the invention emulsion with stirring at 40° C.: 1,3-Benzenedisulfonic acid, 4,5-dihydroxy-, disodium salt (9 mg), NaSCN (100 mg), finish modifier FM, (3-{3-[(methylsulfonyl)amino]-3-oxopropyl} benzothiazolium tetrafluoroborate (35 mg), spectral sensitizing dye SD-1 (three levels were used, 0.946 mmole, 1.037 mmole or 1.127 mmole corresponding to 67.7%, 74%, and 80.7% surface saturation, respectively), a sulfur sensitizer SS, 1,3-dicarboxymethyl-1,3-dimethyl-2-thiourea (1.63 mg), a gold sensitizer GS, bis( 1,4,5-trimethyl-1,2,4-triazolium-3-thiolate) gold(I) tetrafluoroborate (1.57 mg). The emulsion was then heated at 60° C. for 15 minutes, cooled to 40° C., then sequentially; FED-1 (0.4 mg), 1-(3-acetamidophenyl)-5-mercaptotetrazole (115 mg), and 4-hydroxy-6-methyl-1,3,3a,7-tetraazaindene (1.75 gm) were added. For those emulsions illustrating the utility of the inventive compound, either 10 or 20 mg/mole of INV-1 was added before the benzenedisulfonic acid.

The following chemicals (amount per mole silver) were added to the control (comparative) emulsion with stirring at 40° C.: NASCN (100 mg), finish modifier FM, (3-{3-[(methylsulfonyl)amino]-3-oxopropyl} benzothiazolium tetrafluoroborate (40 mg), spectral sensitizing dye SD-1 (0.792 mmole corresponding to 67% surface saturation), 1-(3-acetamidophenyl)-5-mercaptotetrazole (41 mg/mole), a chemical sensitizer $Na_3Au(SO_3)_2.2H_2O$(0.885 mg), an additional sulfur sensitizer $Na_2S_2O_3.5H_2O$ (0.087 mg). The emulsions were then heated at 66° C. for 5 minutes, cooled to 40° C., then sequentially were added: 4-hydroxy-6-methyl-1,3,3a,7-tetraazaindene (2.578 gm), N-2-propynyl-2-benzoxazolamine (2 mg) and finally $Na_3Au(SO_3)_2.2H_2O$ (3.1 mg).

The speed addendum, N-2-propynyl-2-benzoxazolamine for the control emulsion serves the same function as the FED-1 for the inventive emulsion example.

FM

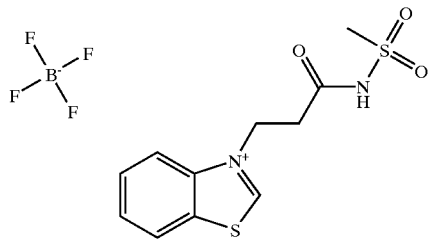

SD-1

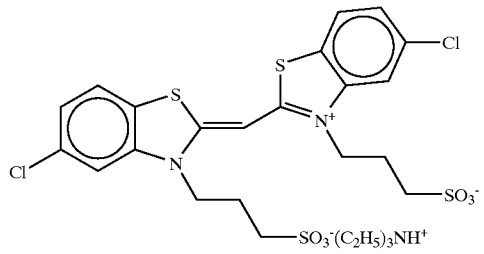

SS

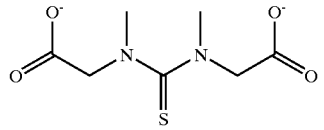

GS

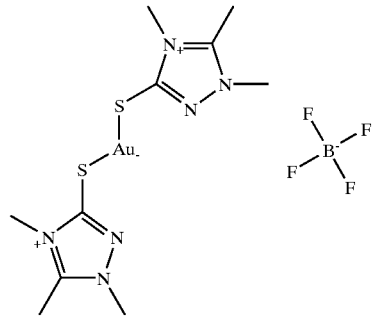

FED-1

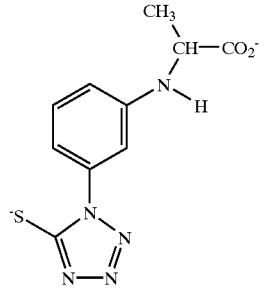

-continued

YC

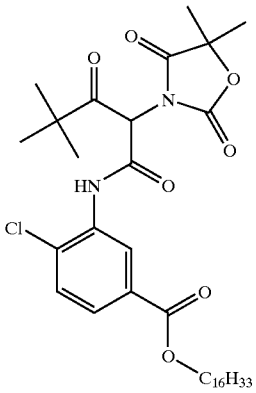

Each of the sensitized emulsions was coated on clear acetate support having an antihalation layer on the opposite side. The coatings had laydowns of 0.81 g/m$^2$ silver, 1.62 g/m$^2$ yellow dye-forming coupler YC, 351HOY, 3.24 g/m$^2$ gelatin and surfactant. A solution of gelatin and bis (vinylsulfonylmethyl)ether was overcoated at 0.9 g/m$^2$ gelatin and 72 mg/m$^2$ hardener, respectively. Each of the film coatings was exposed for 0.01 sec to a 5500 K color temperature tungsten light source filtered through a 2B Kodak Wratten filter with a 0.3 neutral density filter on a 0 to 4 density step tablet. The exposed film coatings were processed using the Kodak Flexicolor™ C-41 color negative film process.

Minimum density, $D_{min}$, speed and granularity are compared in the table below. Dmin is the minimum optical density measured in an unexposed region of the film. Speed is reported in relative log units, where a speed difference of 1 relative log speed difference is equal to an exposure difference of 0.01 log E, where E represents an exposure (measured in lux-seconds). Speed is calculated as 100(1-logH) where H is the minimum exposure in lux-sec necessary to produce a density 0.15 above Dmin.

Granularity is reported as the logarithm of the noise equivalent quanta or log NEQ (J. C. Dainty and R. Shaw "Image Science", 1974). It is a metric used here to characterize the entire exposure range of the film. To calculate the log NEQ of a coated emulsion, the granularity of the processed coating is first determined by the RMS method (see The Theory of the Photographic Process, 4$^{th}$ Edition, T. H. James, pp 625–628) using a 48 $\mu$m aperture. RMS Granularity is the root-mean-squared standard deviation or local density variation in an area of overall uniform density. The rms granularity is determined for each exposure step and is then divided into the instantaneous contrast of that step. This dividend, squared and summed for all exposure steps, is proportional to the noise equivalent quanta of the coated film. This number is also in the same relative log units as speed, the larger the number, the lower (i.e., better) the granularity of the film.

Photographic Evaluation

For the purpose of conducting an unbiased evaluation of Inv-1, a compound that may be expected to control Dmin fog levels, it is necessary to recognize that simple cyanine dyes of which SD-1 is an example, are themselves capable of affecting the finish properties of the emulsion, primarily by restraining the chemical finish and providing low Dmins.

that state-of-the-art low fog and Dmin starch peptized low pH precipitated-emulsions can still be substantially improved upon in a speed-granularity sense by the use of the inventive compound.

TABLE 1

| Sample | Emulsion | Inv-1 mg/Ag mol | Dye Mmole/Ag mole | FED-1 Mg/Ag mole | Dmin | Speed | Log NEQ | Speed-Log NEQ Advantage |
|---|---|---|---|---|---|---|---|---|
| 1 | Emulsion 1 (Comparative) | 0 | 0.792 | 0 | 0.22 | 362 | 2.86 | |
| 2 | Emulsion 2 (Low Fogging) | 0 | 0.946 | 0.4 | 0.14 | 360 | 3.15 | — |
| 3 | Emulsion 2 (Low Fogging) | 10 | 0.946 | 0.4 | 0.08 | 358 | 3.22 | 0.05 log E |
| 4 | Emulsion 2 (Low Fogging) | 0 | 1.037 | 0 | 0.05 | 331 | 3.19 | — |
| 5 | Emulsion 2 (Low Fogging) | 0 | 1.037 | 0.4 | 0.05 | 354 | 3.15 | — |
| 6 | Emulsion 2 (Low Fogging) | 20 | 1.037 | 0.4 | 0.05 | 351 | 3.24 | 0.06 log E |
| 7 | Emulsion 2 (Low Fogging) | 0 | 1.127 | 0.4 | 0.07 | 340 | 3.1 | — |
| 8 | Emulsion 2 (Low Fogging) | 10 | 1.127 | 0.4 | 0.07 | 351 | 3.15 | 0.16 log E |

Thus a low dye level may result in an under-restrained finish (higher Dmin) which would make Inv-1 look unreaslistically good. Conversely, a high level of sensitizing dye might over-restrain the chemical finish and might bias the results on the effect of Inv-1 making it look particularly ineffective.

To avoid this pitfall, the evaluation of Inv-1 was carried out at three distinct dye levels encompassing what is generally accepted as a normal range of dye saturation coverages. Also included for evaluation is a fragmentable electron donor FED-1, a species that is known to increase dyed blue speed of emulsions but carries with it a substantial fog penalty (Farid et al U.S. Pat. Nos. 5,747,235 and 6,010,841).

The low pH precipitated, starch peptized emulsion (Emulsion 2) gives a similar dyed speed to the external control, by virtue of their nearly matched grain diameters, extent of spectral sensitization (67% surface saturation), and use of blue speed addenda. The lower Dmin position of the starch emulsion, coupled with its slightly thinner thickness, gives it a nearly 0.29 log E granularity (log NEQ) advantage over Emulsion 1 . This is not unanticipated based upon the known low fogging of low pH precipitated starch peptized tabular grain emulsions. What is totally unexpected is the observation that this low Dmin can be further improved upon (Sample 3) by the addition of the compound of this invention. The "clean" Dmin of the starch emulsion can further be improved upon by nearly a 50% reduction. This costs only 0.02 log E in speed but is more than compensated for by a 0.07 log E improvement in granularity. The net speed-granularity improvement is thus 0.05 log E (+12%).

At the intermediate dye level (1.037 mmoles or 74% saturation, entries 4,5,6) the effectiveness of the sensitizing dye in restraining Dmin can clearly be seen even in the presence of FED-1. While not improving this already quite good Dmin, Inv-1 does substantially improve the granularity position (0.09 log E) while only forfeiting 0.03 log E in speed. The net speed-granularity advantage here is similar to the low saturation case , 0.06 log E (+15%).

Finally, at the very highest dye saturation level, 80%, this somewhat overdyed case causes a greater loss in dyed speed for the non Inv-1 example, while the treated emulsion still maintains a good granularity position, 3.15. The next speed-granularity advantage her is 0.16 log E (+45%). These results demonstrate quite convincingly the unexpected result The invention has been described in detail with particular reference to certain preferred embodiments thereof, but it will be understood that variations and modifications can be effected within the spirit and scope of the invention.

What is claimed is:

1. A multicolor silver halide photographic element comprising a support and at least one high bromide silver halide emulsion layer comprising low fogging tabular silver halide grains, said element further comprising an antifoggant represented by the following Structure I:

$$R_1—SO_2—C(R_2)R_3—(CO)_m—(L)_n—SG \qquad \text{I}$$

wherein $R_1$ is an aliphatic or cyclic group, $R_2$ and $R_3$ are independently hydrogen or bromine as long as at least one of them is bromine, L is a divalent linking group, m and n are independently 0 or 1, and SG is a solubilizing group that has a pKa of 8 or less.

2. The silver halide photographic element of claim 1 wherein said SG is a phospho, sulfo, carboxy or sulfonamido group, or salt thereof.

3. The silver halide photographic element of claim 1 wherein said SG is a sulfo or carboxy group or salt thereof.

4. The silver halide photographic element of claim 1 wherein both $R_2$ and $R_3$ are bromine.

5. The silver halide photographic element of claim 1 wherein $R_1$ is a trifluoromethyl or a substituted or unsubstituted t-butyl or phenyl group.

6. The silver halide photographic element of claim 1 wherein m and n are each 1.

7. The silver halide photographic element of claim 1 wherein m and n are both 0.

8. The silver halide photographic element of claim 1 wherein m is 1 and n is 0.

9. The silver halide photographic element of claim 1 wherein m is 0 and n is 1.

10. The silver halide photographic element of claim 1 wherein n is 1 and L is a substituted or unsubstituted —NH-alkylene- group.

11. The silver halide photographic element of claim 1 wherein L is an aliphatic linking group.

12. The silver halide photographic element of claim 1 wherein said antifoggant is one or more of the following compounds A-1 to A-31:

A-1
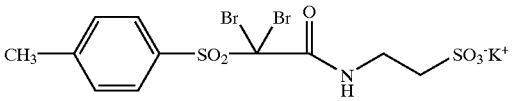
A-2
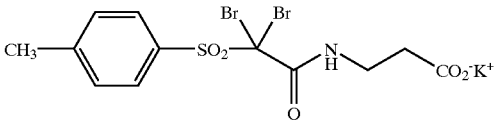
A-3
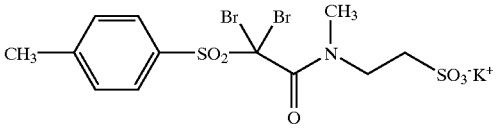
A-4
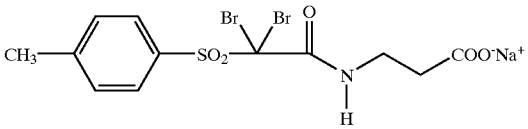
A-5
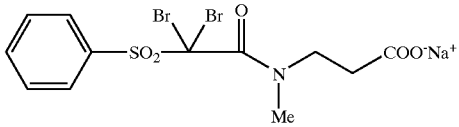
A-6
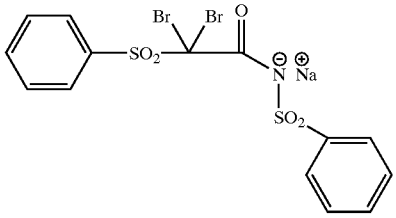
A-7
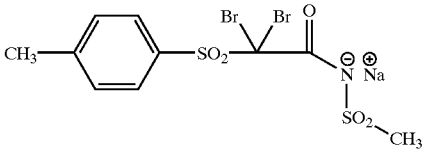
A-8
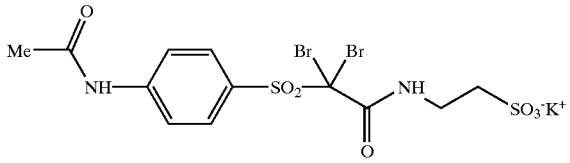
A-9
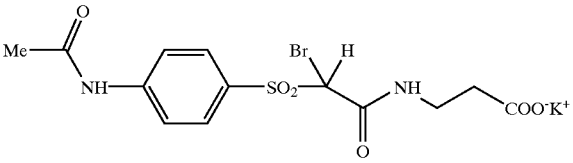
-continued
A-10
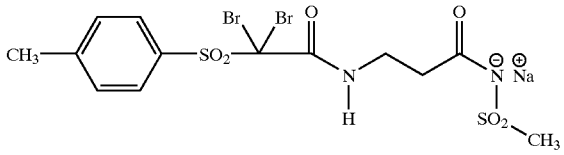
A-11
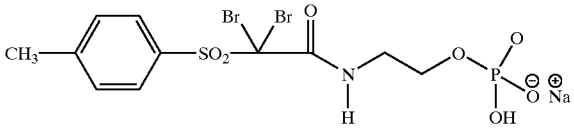
A-12
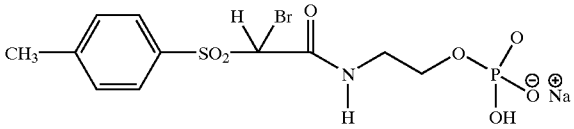
A-13
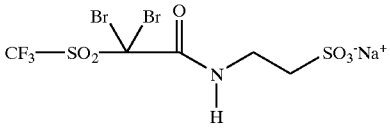
A-14
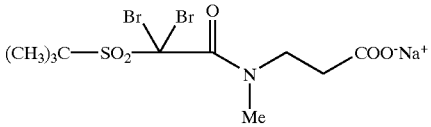
A-15
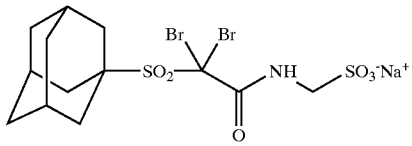
A-16
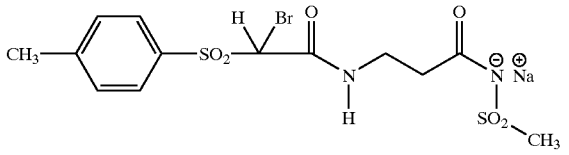
A-17
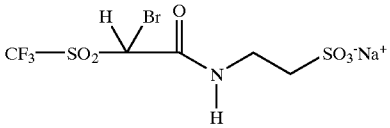
A-18
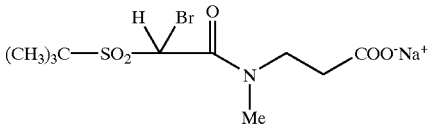
A-19
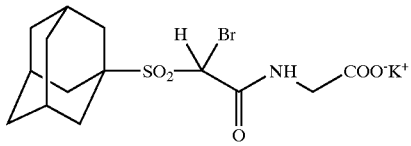

-continued

A-20

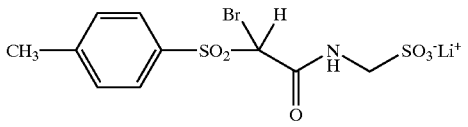

A-21

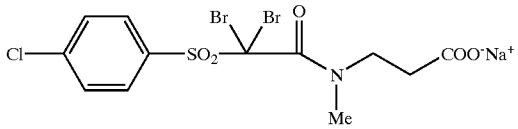

A-22

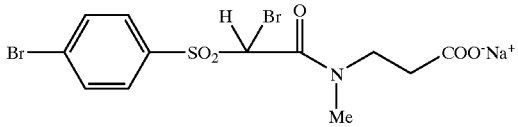

A-23

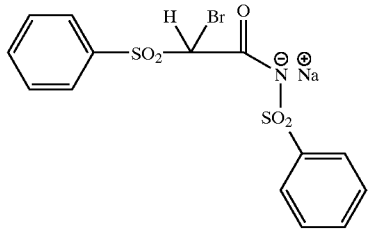

A-24

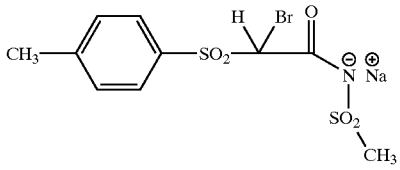

A-25

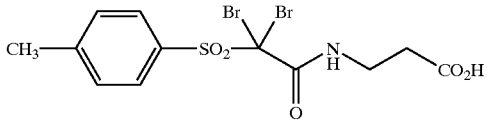

A-26

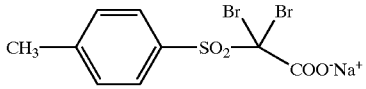

A-27

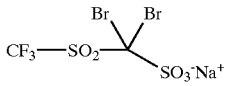

A-28

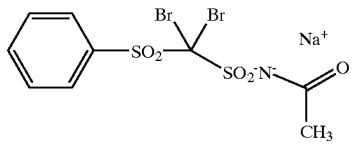

A-29

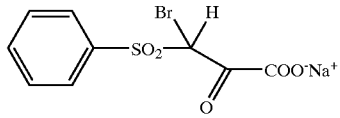

A-30

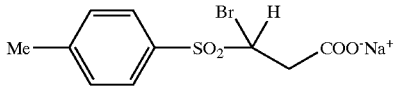

-continued

A-31

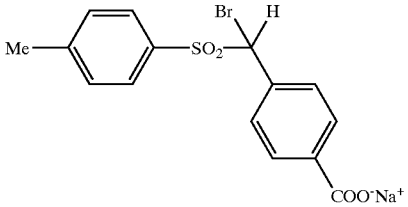

13. The silver halide photographic element of claim 1 wherein the low fogging tabular grains have an average equivalent circular diameter of at least 1 $\mu$m.

14. The silver halide photographic element of claim 1 wherein the low fogging tabular grains have an average iodide content of less than 6.0%.

15. The silver halide photographic element of claim 1 comprising a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, wherein at least one of said dye image-forming units comprises the high bromide silver halide emulsion containing low fogging tabular grains and further comprises a two-equivalent image dye coupler.

16. The silver halide photographic element of claim 1 wherein the high bromide silver halide emulsion containing low fogging tabular silver halide grains has been precipitated in a reaction vessel and the majority of grain growth in the reaction vessel was performed at a pH of less than 4.0.

17. The silver halide photographic element of claim 1 wherein the high bromide silver halide emulsion containing low fogging tabular silver halide grains has been precipitated in an aqueous medium containing a peptizer that is a water dispersible starch.

18. The silver halide photographic element of claim 17 wherein the starch peptized high bromide silver halide emulsion containing low fogging tabular silver halide grains has additionally been precipitated in the presence of an oxidizing agent capable of oxidizing metallic silver.

19. The silver halide photographic element of claim 17 wherein the starch is a water dispersible cationic starch.

20. The silver halide photographic element of claim 17 wherein the starch peptized high bromide silver halide emulsion containing low fogging tabular silver halide grains has been precipitated in a reaction vessel and the majority of grain growth in the reaction vessel was performed at a pH of less than 4.0.

21. The silver halide photographic element of claim 20 wherein the starch peptized high bromide silver halide emulsion containing low fogging tabular silver halide grains has further been precipitated in the presence of an oxidizing agent capable of oxidizing metallic silver.

* * * * *